US011578569B2

(12) United States Patent
Rodger

(10) Patent No.: US 11,578,569 B2
(45) Date of Patent: Feb. 14, 2023

(54) APPARATUS AND METHODS FOR A GAS LIFT VALVE

(71) Applicant: RCE Corporation, Houston, TX (US)

(72) Inventor: George Joel Rodger, Houston, TX (US)

( * ) Notice: Subject to any disclaimer, the term of this patent is extended or adjusted under 35 U.S.C. 154(b) by 40 days.

(21) Appl. No.: 16/972,057

(22) PCT Filed: Apr. 30, 2020

(86) PCT No.: PCT/US2020/030621

§ 371 (c)(1),
(2) Date: Dec. 4, 2020

(87) PCT Pub. No.: WO2020/223437

PCT Pub. Date: Nov. 5, 2020

(65) Prior Publication Data

US 2021/0172300 A1 Jun. 10, 2021

Related U.S. Application Data

(60) Provisional application No. 62/840,662, filed on Apr. 30, 2019.

(51) Int. Cl.
*E21B 43/12* (2006.01)

(52) U.S. Cl.
CPC ..... *E21B 43/123* (2013.01); *E21B 2200/03* (2020.05)

(58) Field of Classification Search
CPC .... E21B 43/123; E21B 43/1235; E21B 43/13; E21B 2200/03; E21B 33/00
See application file for complete search history.

(56) References Cited

U.S. PATENT DOCUMENTS 4,790,378 A * 12/1988 Montgomery ..... E21B 41/00 307/118
5,176,164 A * 1/1993 Boyle ..... E21B 34/06 137/155

(Continued)

FOREIGN PATENT DOCUMENTS

WO WO-0155554 A1 * 8/2001 ..... E21B 17/003
WO WO2018/096312 A1 5/2018
WO WO-2018096312 A1 * 5/2018 ..... E21B 29/04

*Primary Examiner* — George S Gray
(74) *Attorney, Agent, or Firm* — Matthew J Patterson

(57) ABSTRACT

A system and method for controlling production fluid flow between an annular chamber extending between a casing disposed in a downhole bore and production tubing disposed in the casing. An electrically down hole control valve which includes a motor, a position sensor, a gearbox and a linear actuator coupled to the gearbox to convert rotational movement to an axial movement. The control valve further includes a connecting rod coupled to the linear actuator and a valve assembly. The valve assembly includes a gate that can translate in an axial direction to a plurality of continuously variable positions between a fully closed position and a fully open position. A plurality of such control valves can be disposed in respective openings formed in the production tubing, and a passage is formed in each valve for connecting the annular chamber and the production tubing interior. The valves are selectively closed and selectively opened to permit fluid flow to and from the chamber, through the passage, and to and from the interior of the production tubing. Thus, the volume of fluid passing to and from the chamber, through the valve members, and to and from the interior of the production tubing is controlled.

14 Claims, 12 Drawing Sheets

(56) References Cited

U.S. PATENT DOCUMENTS

| | | | | |
|---|---|---|---|---|
| 6,484,800 | B2 | 11/2002 | Carmody et al. | |
| 6,595,487 | B2 | 7/2003 | Johansen et al. | |
| 6,840,317 | B2 * | 1/2005 | Hirsch | E21B 34/066 166/250.15 |
| 6,913,240 | B1 | 7/2005 | MacKenzie | |
| 8,066,075 | B2 | 11/2011 | Cowie et al. | |
| 8,225,874 | B2 | 7/2012 | Messick et al. | |
| 9,291,033 | B2 | 3/2016 | Scott et al. | |
| 2013/0248203 | A1 * | 9/2013 | Scott | E21B 34/066 166/373 |
| 2017/0343986 | A1 * | 11/2017 | Zhang | E21B 43/122 |
| 2018/0149002 | A1 * | 5/2018 | Murdoch | E21B 34/066 |

* cited by examiner

APPARATUS AND METHODS FOR A GAS LIFT VALVE

CROSS REFERENCE TO RELATED APPLICATIONS

This application claims the benefit of U.S. Provisional Patent Application Ser. No. 62/840,662 filed 30 Apr. 2019 as well as International application No. PCT/US20/30621 filed 30 Apr. 2020. The disclosure of the applications above are incorporated herein by reference in its their entirety.

BACKGROUND OF THE INVENTION

Field of the Invention

The present invention relates to an electrically actuated gas lift valve and methods and systems related thereto for use in oil and gas wells.

Description of the Related Art

This disclosure relates generally to valves, control systems and methods for controlling the flow of oil and gas between a well bore casing and a production tubing and, more particularly, to such systems and methods utilizing a plurality of valves for controlling the injection of a fluid to increase oil and gas flow from the well.

In oil production installations, a well bore annulus, or casing, lines the well bore. Oil, water and gas (hereinafter "production fluid") present in an underground oil reservoir flows into the casing through perforations in the casing. Production tubing for transporting the production fluid from the reservoir level is disposed in the casing and extends upwards to the ground surface.

In production methods commonly referred to as gas lift, a valve is often used to control injection fluid (typically natural gas) flow from a lifting fluid supply from inside the casing to the production tubing. The most common type of conventional gas lift valve is a ball and seat type valve where the ball stem is normally energized by a nitrogen gas charged bellows. An exemplary valve of this type in the prior art is disclosed in U.S. Pat. No. 3,223,109, the disclosure of which is incorporated herein in its entirety.

Another valve is used to control production fluid flow from inside the casing to the production tubing. One type of conventional valve uses a sliding sleeve valve, or choke, that utilizes a slotted sleeve which axially slides over a slotted port. However, such prior art choke valves do not allow for any fine incremental control of the production fluid flow. Furthermore, the linearly sliding choke occupies a relatively large space, which can be a major disadvantage since the casing interiors are relatively narrow, thus requiring greater valve lengths, and thus more material to manufacture the valve.

Other valve designs use an electro-hydraulic control system to fully open or fully close a valve, and a solenoid to control a hydraulic line. However, this design also does not allow for fine incremental production fluid flow control, utilizes a relatively large amount of electrical power, and is also relatively bulky.

Many of the aforementioned problems with gas lift valves and methods are is disclosed in U.S. Pat. No. 5,937,945 (the '945 patent"), the disclosure of which is incorporated herein in its entirety. The '945 patent discloses the lack of regulation inherent in prior art gas lift valves that have only two positions, either fully opened or fully closed. The '945 patent further discloses prior art gas lift valves attempts at solving the regulation problems by having a variable openness suffering themselves from having a lack of reliability caused by such things as scale and debris. One of the reasons for such problems is that the variability of such prior art valves is fairly course typically on the order of 1/32 of an inch. The '945 patent attempted to solve the problem of prior art gas lift valves by employing a plurality of ports which are selectively positioned in a fully opened condition or a fully closed positioned. This arrangement allowed a degree of regulation based on the size and number of ports but did not permit a continuously variable amount of regulation of the valve.

Another prior art gas lift valve is disclosed in publication number US20190316440 (the '440 application) directed at addressing some of the issues of the prior art concerning the "fine" adjustment of a valve. The most detailed embodiment of the '440 application includes a motor that drives a worm gear to produce an axial movement of a "dart" that comprises the sealing portion of the valve. It is known in the prior art that downhole pressures can exceed several thousand pounds per square inch or more. In such conditions a valve of the '440 application would have the tendency to backspin the motor which would alter the position of the valve making it difficult to maintain the dart in a particular position or even closed without the motor being constantly energized. In addition, the adjustability of the valve is predetermined by the pitch of the thread wherein the dart moves axially a set amount per actual rotation of the motor leading to what may a less than adequate amount of adjustment for the operating conditions of the well. Another noticeable problem of the embodiments disclosed in the '440 is that the motor is subject to the aforementioned downhole pressures of which the motor must overcome prior to producing the forces necessary to move the dart in an axial direction. The motor of the '440 application must also be sized to produce enough torque to produce the axial movement of dart through the worm gear thread arrangement which may require more electrical power than is generally available in a downhole environment.

Therefore, what is needed is a gas lift valve and system that provides fine continuously variable, incremental control over the fluid flow through the valve, yet is simple, inexpensive, and relatively small in size.

SUMMARY OF THE INVENTION

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a downhole valve for controlling fluid flow. The downhole valve also includes a drive section which may include a motor adapted to provide rotational movement of a motor shaft, a position sensor coupled to the motor and adapted to determine a rotation position of the motor, a gearbox coupled to the motor shaft and adapted to provide a rotational movement of a gearbox shaft, and a linear actuator coupled to the gearbox and adapted to convert the rotational movement of a gearbox shaft to an axial movement in an axial direction. The valve also includes a connecting rod coupled to the linear actuator. The valve further includes a valve assembly that includes an inlet and an outlet and a gate slidably positioned between the inlet and the outlet, the gate coupled to the linear actuator. Other embodiments of this aspect include corresponding computer systems, apparatus, and computer programs recorded on one or more computer storage devices, each configured to perform the actions of the methods.

Implementations may include one or more of the following features. The downhole valve for controlling fluid flow may include a motor controller coupled to the motor and adapted to control the axial movement such that the connecting rod causes the gate to translate in the axial direction between the inlet and the outlet. The motor controller is further adapted to control the axial movement in a continuously variable mode such that the connecting rod causes the gate to translate in the axial direction to a plurality of continuously variable positions between a fully closed position and a fully open position. The gate may include a valve pin and where the valve pin is positioned against the valve seat in the fully closed position. The downhole valve for controlling fluid flow may include a check valve positioned proximate the outlet and adapted to prevent fluid flow from the outlet to the inlet. The downhole valve for controlling fluid flow may include an inside valve seat positioned in fluid communication with the inlet and having an inside valve seat orifice positioned therethrough an outside valve seat positioned in fluid communication with the outlet having an outside valve seat orifice positioned therethrough and the gate coupled to the linear actuator and slidably positioned between the inside valve seat and the outside valve seat, the gate having at least one gate orifice positioned perpendicular to the axial direction therethrough. The at least one gate orifice is in fluid communication with the inside valve seat orifice and the outside valve seat orifice between the fully closed position and the fully open position. The at least one gate orifice may include a flow profile and where the flow profile is any of a circle, an elongated ellipse, a teardrop and a venturi. The outlet is positioned substantially perpendicular to the substantially cylindrical primary bore and in fluid communication with the sub port, and where the downhole valve is adapted to control fluid flow between the sub port and the inlet. The downhole valve is adapted to control fluid flow in a bidirectional mode in any of a first direction from the inlet to the sub port and a second direction from the sub port to the inlet. The downhole valve for controlling fluid flow may include a check valve positioned proximate the sub port and adapted to prevent fluid flow from the substantially cylindrical primary bore to the inlet. The linear actuator is threadably engaged with a portion of the connecting rod. The bellows is further coupled to the connecting rod, and where the axial movement causes an expansion of the bellows or a compression of the bellows and further causes the compensation piston to move axially. The isolated chamber is substantially filled with an incompressible fluid. Any of the motor, the gearbox, the position sensor and the linear actuator are positioned within the isolated chamber. Implementations of the described techniques may include hardware, a method or process, or computer software on a computer-accessible medium.

The well production system also includes a well having a wellbore a casing positioned in the wellbore, a production tubing positioned within the casing and defining an annulus therebetween, a plurality of remotely controlled valves positioned at predetermined locations along the production tubing and includes a drive section that may include a motor adapted to provide rotational movement of a motor shaft, a position sensor couple to the motor and adapted to determine a rotation position of the motor, a gearbox coupled to the motor shaft and adapted to provide a rotational movement of a gearbox shaft, and a linear actuator coupled to the gearbox and adapted to convert the rotational movement of a gearbox shaft to an axial movement in an axial direction. The system also includes a connecting rod coupled to the linear actuator and a valve assembly may include an inlet and an outlet. The system also includes a valve assembly having an inlet and an outlet and a gate slidably positioned between the inlet and the outlet, the gate coupled to the linear actuator. The system also includes at least one sensor adapted to sense at least one environmental parameter. The system also includes a motor controller coupled to each of the plurality of remotely controlled valves and adapted to control the axial movement in a continuously variable mode such that the connecting rod causes the gate to translate to a continuously variable position between a fully closed position and a fully open position. The system also includes where the motor controller is adapted to control each of the plurality of remotely controlled valves based at least in part on the at least one environmental parameter. Other embodiments of this aspect include corresponding computer systems, apparatus, and computer programs recorded on one or more computer storage devices, each configured to perform the actions of the methods.

Implementations may include one or more of the following features. The well production system where the motor controller is adapted to position at least one of the plurality of remotely controlled valves to direct a flow of a fluid from any of the annulus into the production tubing or the production tubing into the annulus. The well production system may include a processor adapted to receive information from the at least one sensor and further adapted to determine an operating parameter of any of the plurality of remotely controlled valves, the annulus and the production tubing. The processor can be further adapted to control the production wing valve and the casing wing valve between an open position and a closed position. The well production system may include a lifting fluid supply adapted to be coupled to the production wing valve to provide for tubing injection and adapted to be coupled to the casing wing valve to provide for annulus injection. The well production system may include a bottom hole sensor positioned proximate a bottom depth of a well and adapted to sense any of a tubing pressure in the production tubing or an annulus pressure in the annulus proximate a bottom depth, a surface production sensor positioned proximate the production wing valve adapted to sense the tubing pressure proximate the production wing valve a surface annulus sensor positioned proximate the casing wing valve adapted to sense the annulus pressure proximate the casing wing valve and the processor further adapted to control any of the production wing valve, the casing wing valve and the plurality of remotely controlled valves based on any of the at least one sensor, the bottom hole sensor, the surface production sensor, and the surface casing sensor. Implementations of the described techniques may include hardware, a method or process, or computer software on a computer-accessible medium.

One general aspect includes a method of operating a downhole fluid control valve. The method also includes providing a valve assembly having a plurality of continuously variable positions between a fully open position and a fully closed position coupling the valve assembly to a production tubing string in a well, providing a control signal to the valve assembly, to position the valve in a predetermined one of the continuously variable positions, and controlling a fluid flow between the tubing string and an annulus through the valve assembly. Other embodiments of this aspect include corresponding computer systems, apparatus, and computer programs recorded on one or more computer storage devices, each configured to perform the actions of the methods.

Implementations may include one or more of the following features. The method of operating a downhole control valve where the providing of the control signal may include rotating a motor, rotating a gearbox coupled to the motor, actuating a linear actuator coupled to the gearbox, producing an axial movement of a gate coupled to the linear actuator, and positioning the gate to a predetermined one of the plurality of continuously variable positions. The positioning the gate to a predetermined one of the plurality of continuously variable positions may include sensing a rotational position of the motor and positioning the gate based on the rotational position. The method of operating a downhole control valve may include coupling the valve assembly to a production tubing string in a well, and controlling a fluid flow between the production tubing string and an annulus. The method of operating a downhole control valve may include sensing at least one parameter, and adjusting the gate to a different predetermined one of the plurality of continuously variable positions based on the at least one parameter. The method of operating a downhole control valve may include determining a flow rate through the valve assembly based on the at least one parameter. The controlling a fluid flow between the production tubing string and an annulus is any of controlling the fluid flow from the production tubing string to the annulus and controlling the fluid flow from the annulus to the production tubing string. Implementations of the described techniques may include hardware, a method or process, or computer software on a computer-accessible medium.

One general aspect includes a method of controlling the production of a well. The method also includes coupling a plurality of remotely controlled valves at predetermined locations along a length of a production tubing disposed in the well selectively controlling at least one of the plurality of remotely controlled valves to one of a plurality of continuously variable positions between a fully closed position and a fully open position, and controlling a fluid flow between the production tubing and an annulus. Other embodiments of this aspect include corresponding computer systems, apparatus, and computer programs recorded on one or more computer storage devices, each configured to perform the actions of the methods.

Implementations may include one or more of the following features. The method of controlling the production of a well may include sensing at least one parameter, and selectively adjusting at least one of the plurality of remotely controlled valves to a different predetermined one of the plurality of continuously variable positions based on the at least one parameter. Where the fluid flow is an annulus injection fluid, the method may include providing the annulus injection fluid into the annulus and controlling the fluid flow of the annulus injection fluid from the annulus to the production tubing through at least one of the plurality of remotely controlled valves. Where the fluid flow is a tubing injection fluid, the method may include providing the tubing injection fluid into the production tubing and controlling the fluid flow of the tubing injection fluid from the production tubing to the annulus through at least one of the plurality of remotely controlled valves. The at least one parameter is any of a bottom hole tubing pressure, a bottom hole annulus pressure, a pressure sensed at any of the plurality of remotely controlled valves, a surface tubing pressure and a surface annulus pressure and controlling the fluid flow of any of the annulus injection fluid and the tubing injection fluid based on the injection rate and the at least one parameter by selectively adjusting at least one of the plurality of remotely controlled valves to a predetermined one of the plurality of continuously variable positions. Implementations of the described techniques may include hardware, a method or process, or computer software on a computer-accessible medium.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following detailed description of the embodiments, reference is made to the accompanying drawings, which form a part hereof, and within which are shown by way of illustration specific embodiments by which the examples described herein may be practiced. It is to be understood that other embodiments may be utilized and structural changes may be made without departing from the scope of the disclosure.

Figure 1:
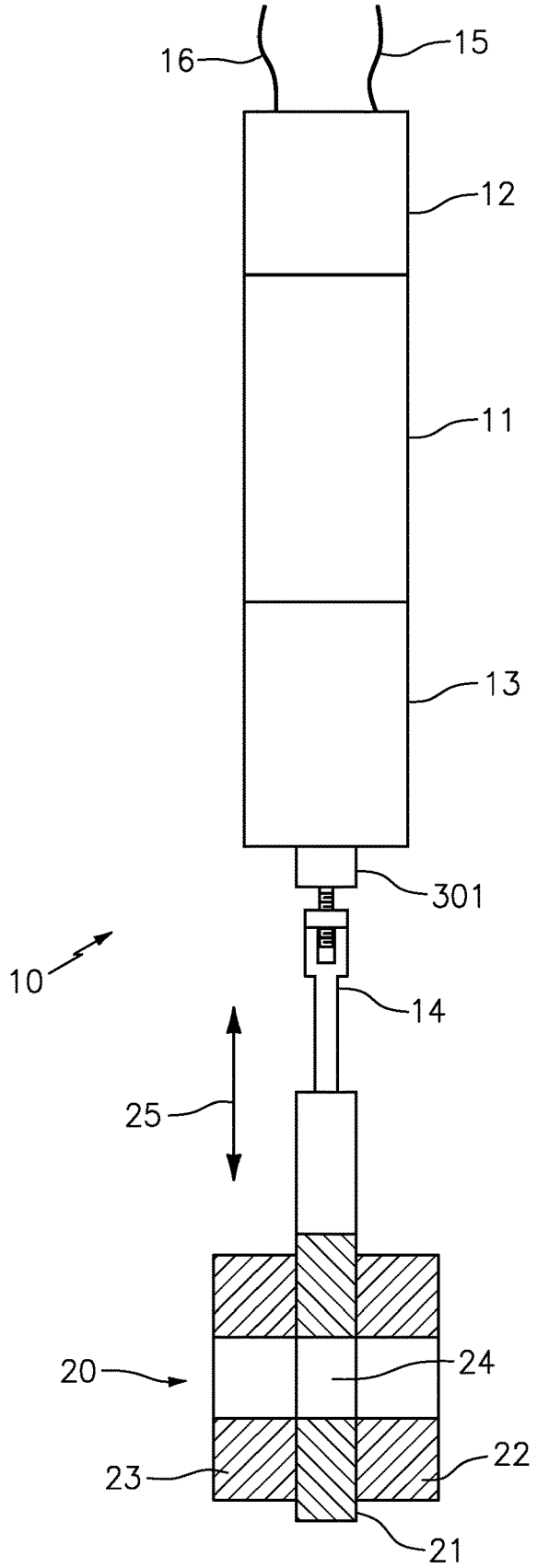
FIG. 1 is a side view of an embodiment of a control valve in accordance with the present invention.

Referring to FIG. 1, there is shown an embodiment of a downhole control valve in the form of control valve 10 in accordance with the present disclosure. In this particular embodiment, control valve 10 is comprised of an electric motor 11, a position sensor such as position sensor 12, a gear assembly 13, a linear actuator 301, and a connecting rod 14. control valve 10 is configured to be supplied with by electrical power through power cable 15 and feedback signals from position sensor 12 are sent via encoder wire 16. control valve 10 further comprises valve assembly 20 which includes gate 21 attached to connecting rod 14, an inside valve seat 23 and an outside valve seat 22. In the embodiment shown, gate 21 has a circular gate profile 24 shown in the fully open position providing an unimpeded fluid communication path through valve assembly 20 as will be explained in more detail herein after. Gate 21 is bidirectionally moved by motor 11 and connecting rod 14 in the direction of arrow 25 to provide a plurality of continuously variable positions and fine adjustment of the amount of open area of gate profile 24 and a precise valve opening positioning capability thereby. In other embodiments, motor 11 can comprise a solenoid and ratchet system.

Still referring to FIG. 1, position sensor 12 can comprise a transducer, such as an optical or magnetic encoder, that is capable of sensing the position of the rotor of motor 11 to provide active feedback of the position gate 24 and to control its position thereby. In certain embodiments, position sensor 12 comprises a rotary encoder that coverts the position of the shaft of motor 11 to an analog or digital electronic signal that is communicated through encoder wire 16. Position sensor 12 can be either absolute or incremental. The signal from an absolute encoder gives an unambiguous position of the shaft of motor 11 within the travel range without requiring knowledge of any previous position. The signal from an incremental encoder is cyclical, thus ambiguous, and requires counting of cycles to maintain absolute position within the travel range. Both types of encoders can provide the same accuracy; the absolute encoder is more robust to interruptions in transducer signal, whereas the incremental encoder reports position changes in real time. In one particular embodiment, position sensor 12 can comprise a hall effect sensor with associated electronics to count the number of rotations of motor 11 to determine the position of the gate 21. Motor 11 is a rotary motor and can be an inductance motor or a permanent magnet motor. Gearbox 13 is a high gear ratio reduction type gear box, having a ratio for example of 600:1, that coverts the rotation of the motor 11 into a high torque rotation of connecting rod 14. The gearbox 13 is fixedly attached to a linear actuator 301. The linear actuator converts the rotational movement of the output shaft of gearbox 13 to an axial movement along the axis of motor 11. Linear actuator 301 can comprise a ball screw which is threadably coupled to ball screw nut 302 positioned on an end of connecting rod 14. Ball screw nut includes ball bearings and moves along the ball screw shaft of linear actuator 301 as it rotates. In an alternative embodiment, a rod (not shown) with a power screw thread can be connected to shaft of the gearbox. The rod then screws into a mating coupling that is connected to connecting rod 14. It should be apparent to those skilled in the art that as linear actuator 301 translates connecting rod 14, gate 21 is simultaneously translated continuously finely adjusting the opening of orifice 24 relative to inside seat 23 and outside seat 22 to enable a plurality of partially open positions as well as a fully opened position and a fully closed position. It should be noted that the combination of gearbox 13 and linear actuator 301 inventively provide orders of magnitude greater adjustment than that of the aforementioned '440 application which enables the near infinite continuously adjustable opening of gate orifice 24. In another alternative embodiment, the connecting rod 14 is attached to gate 21 and can include screw threads that threadably engage the gate 21 such that when motor 11 rotates the connecting rod either screws into or out of the end of gate 21 (depending on the rotational direction of motor 11) and translates the gate in the direction of arrow 25. It should be appreciated by those skilled in the art that control valve 10 of the present disclosure, through the use of motor 11, gearbox 13 and linear actuator 301, produces a large linear force on gate 21, in some embodiments the force can be greater than 400 foot pounds, which is capable of being adjusted in the presence of high pressure conditions, overcoming the buildup of scale, paraffin and debris, enables the control valve to be placed at deeper positions within the well, and the control valve can be adjusted/operated during the injection of high pressure fluid.

Figure 2:
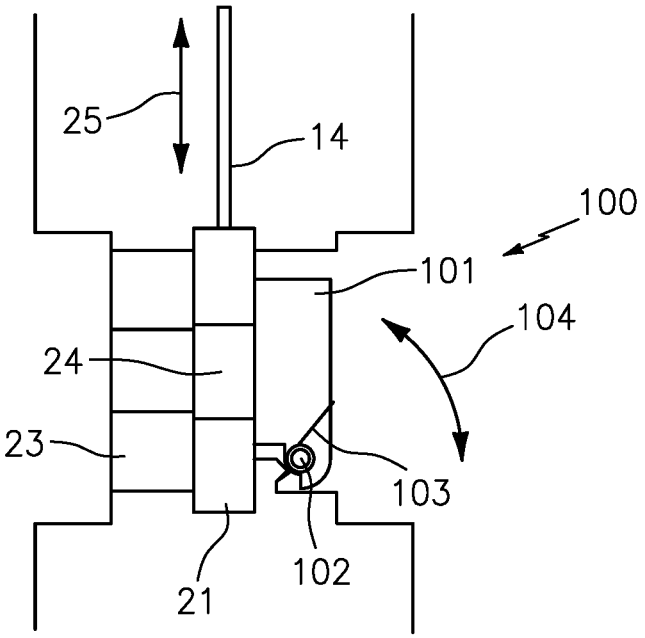
FIG. 2 is a side view of an alternative embodiment of a control valve in accordance with the present invention.

Referring now to FIG. 2, there is shown an alternative embodiment of control valve 10 wherein outside valve seat 22 (FIG. 1) is replaced with flapper valve assembly 100. Flapper valve assembly 100 comprises a flapper valve 101 pivotably mounted at hinge 102 and includes spring 103. In normal operation, spring 103 biases flapper valve 101 in a closed position sealing off orifice 24 and preventing fluid flow from the wellbore to the annulus. When the pressure within the annulus is increased beyond the bias force of spring 103 flapper valve 101 pivots open in the direction of arrow 104 and fluid is allowed to flow from the annulus to the wellbore to provide gas lifting pressure to produce the production fluids. When the pressure in the wellbore is increased below the bias force of spring 103 flapper valve 101 pivots closed in the direction of arrow 104 and fluid flow from the well to the annulus is blocked.

Figure 3:
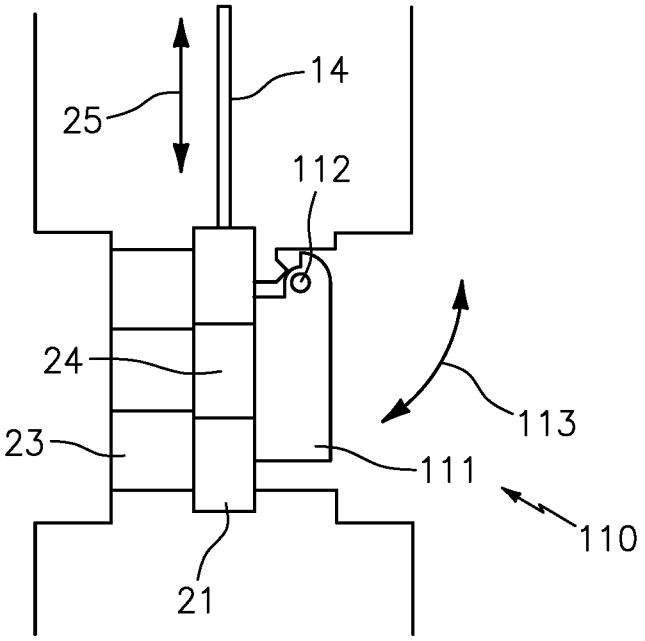
FIG. 3 is a side view of an alternative embodiment of a control valve in accordance with the present invention.

Referring now to FIG. 3 there is shown yet another alternative embodiment of control valve 10 wherein outside valve seat 22 (FIG. 1) is replaced with flapper valve assembly 110. Flapper valve assembly 110 comprises a flapper valve 111 pivotably mounted at hinge 112. In normal operation the weight of flapper valve 101 biases the flapper valve in a closed position sealing off orifice 24 and preventing fluid flow from the wellbore to the annulus. When the pressure within the annulus is increased beyond the bias force of the weight of flapper valve 111 the valve pivots open in the direction of arrow 113 and fluid is allowed to flow from the annulus to the well to provide gas lifting pressure to produce the production fluids. When the pressure in the wellbore is increased below the bias force of the weight of flapper valve 101 the valve pivots closed in the direction of arrow 113 and fluid flow from the well to the annulus is blocked.

Figure 4:
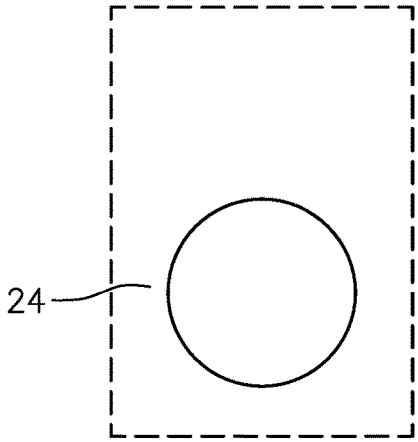
FIG. 4 is an illustration of a gate profile of a control valve in accordance with the present invention.
Figure 6:
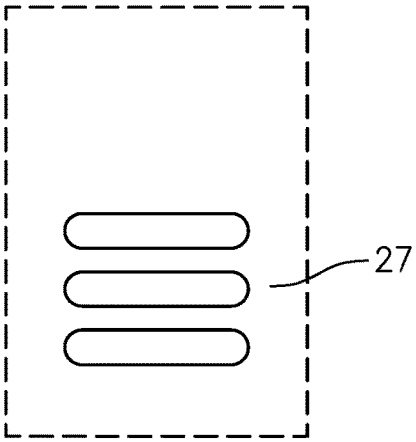
FIG. 6 is an illustration of a gate profile of a control valve in accordance with the present invention.
Figure 5:
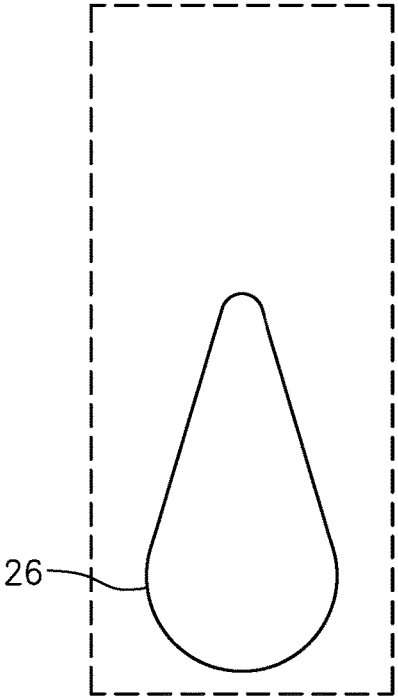
FIG. 5 is an illustration of a gate profile of a control valve in accordance with the present invention.
Figure 7:
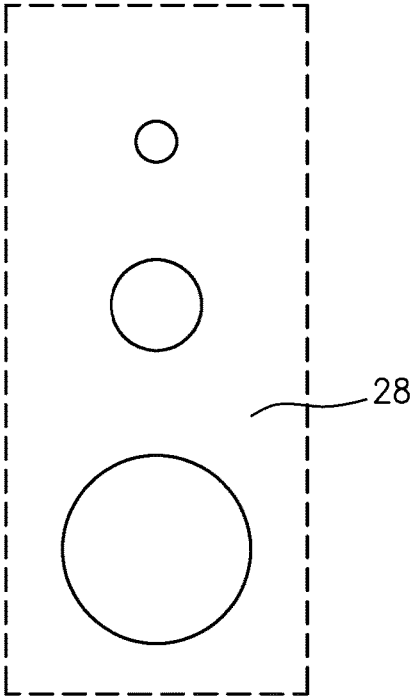
FIG. 7 is an illustration of a gate profile of a control valve in accordance with the present invention.
Figure 7A:
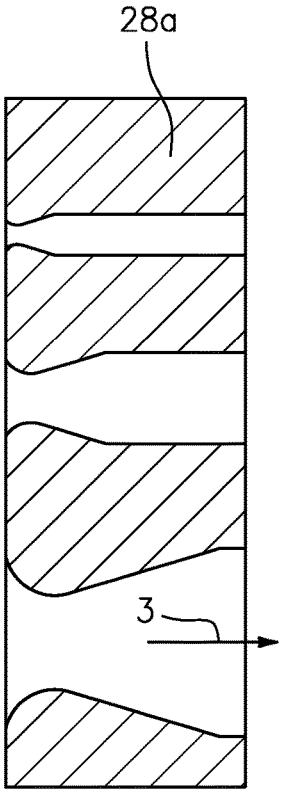
FIG. 7*a* is an illustration of a gate profile of a control valve in accordance with the present invention.

As part of the present disclosure, the shape, size, number and other attributes of gate profile 24 (FIG. 1) can comprise various embodiments to provide different operating parameters in providing the continuously variable positioning and fine incremental adjustment of fluids produced through valve assembly 20. For instance, gate profile 24 of FIG. 1 is shown with reference to FIG. 4. As will be described in more detail herein below, some embodiments of control valve 10 include the ability to control the movement of gate 21, and the opening of the port thereby, increments of 1/100 of inch or better. It should be appreciated by those skilled in the art that gate profile 24 provides a simple and inexpensive profile and is a predictable full open flow and with an almost infinite adjustment on the order of 1/100 of an inch of axial movement from fully open to fully closed when translated in the direction of arrow 25 by use of position sensor 12. An alternative gate profile 26 is shown with reference to FIG. 5, wherein the coefficient of discharge ($C_d$) of profile 26 varies almost linearly with the position of the gate. In such an embodiment, the valve assembly 20 provides a linear $C_d$ response as gate 21 translates within profile 26 relative to inside seat 23 and outside seat 22. In this embodiment inside seat 23 and outside seat 22 can have the same profile as gate profile 24, or the inside seat and outside seat can have different profiles producing a different $C_d$ response as the gate translates the profile. Another alternative gate profile 27, which comprises a relatively rapid opening/closing profile, is shown with reference to FIG. 6, and in this embodiment inside seat 23 and outside seat 22 can have the same profile as gate profile 27 or have different profiles producing a different $C_d$ response as the gate translates the profile. It should be appreciated that in this embodiment as gate 21 is translated in the direction of arrow 25 the gate need only travel a short distance, relative to gate profiles 24, 26, to go from fully open position to fully closed position. The number of ports show in FIG. 6 is merely illustrative and can be increased or decreased depending on the desired opening size for a given translation of gate 21 and the desired $C_d$ response of the valve. FIG. 7 shows profile 28 where multiple size ports are in a single gate 21. Only one of these openings at a time will line up with the opening of the seats 22 and 23. This embodiment provides the ability to have a known and different orifice size available for a user to provide a different $C_d$ response as the gate 21 translates profile 28. In an alternative embodiment, ports 28*a* can have an interior profile, such as a venturi, to provide a more predictable and stable flow response. In such an embodiment, injection gas would flow through the venturi of one of the ports of 28*a* from the annulus 31 to the production tubing 32 in the direction of arrow 3. It should be appreciated by those skilled in the art that as the injection gas flows through the venturi of one of the ports 28*a* of gate 21 in the direction of arrow 3, the injection gas will stay thoroughly mixed and expand as it exits into the production tubing. With this capability and the ability change the port geometries to different profiles to allow that small movement to achieve different results provides the end user with significant advantages to operating their gas lift well, water flood, etc.

Operation of control valve 10 can be described with reference to FIG. 8 wherein the control valve of FIG. 1 is mounted within housing 30, which can be comprised of any number of components, and positioned within annular chamber 31 and mounted to a wall of production tubing 32. Annular cavity 31 is formed between casing 33 and production tubing 32 which are positioned in a borehole drilled in earth 34. In this particular embodiment, control valve 10 further includes electronics assembly 35 in electronic communication with the control valve, which is connected to the power cable 15 and encoder wires 16. Electronics assembly 35 is connected to communication and power cable 36 that runs from the surface to control valve 10. Electronics assembly 35 can include such hardware capable of providing a control signal, communications, power management, sensor calculations, memory and the like. It should be noted that while gate 21 is in the open position there exists two-way fluid communication (indicated by arrows 37, 38) between production tubing 32 and annular chamber 31. It should further be appreciated by those skilled in the art that when the pressure inside annular chamber 31 is greater than the pressure in production tubing 32 fluid will flow through control valve 10 from the annular chamber into the production tubing and when the pressure inside annular chamber 31 is less than the pressure in production tubing 32 fluid will flow through control valve 10 into the annular chamber from the production tubing. The embodiment of FIG. 8 can also include a first sensor 39 and a second sensor 40. First sensor 39 can be a pressure and temperature sensor capable of measuring the pressure and temperature of fluids in annular chamber 31 and second sensor 40 can be a pressure and temperature sensor capable of measuring the pressure and temperature of fluids in production tubing 32. The embodiment further includes power cable 36 that passes through housing 30 that can be operably connected to other sensors and control valve's as will be described in more detail herein after connected in series, down the well in what is known as a "multidrop" communication method. Fluid injection line 75 is also in fluid communication with valve assembly 10. Fluid injection line 75 can pass through valve assembly 10 and fluidly connect to subsequent control valves 10 as will be described more fully herein after. Selector valve 76 is configured to control the flow injection line 75 to be diverted into the control valve injection port 77 and into the fluid stream by passing control valve 10.

Using first sensor 39 and second sensor 40, as described herein above, the pressure and temperature of fluids in annular chamber 31 and the pressure and temperature fluids in production tubing 32 can be determined. Together with the precise position and profile of the gate 21 and providing the fluid properties, control valve 10 is inventively capable of calculating the flow rate through the control valve using empirical modeling or other more advance flow approximation techniques as are known by those skilled in the art. The calculations to determine flow rate through the control valve can be performed in the electronics assembly 35 or in the surface controller 80. The calculated flow rate can be used to identify a leak when the well is shut in, or to determine the amount of fluid passing through control valve 10 in normal operation. In addition, the flow rate values from multiple control valve's 10 can be used to analyze the flow rates or flow regime that is taking place. For example, the temperature and pressure for multiple sensors 40 can inventively be used in the surface control to empirically or mathematically model the flow rate and regime in the production tubing 32 using techniques known by those skilled in the art.

Figure 8:
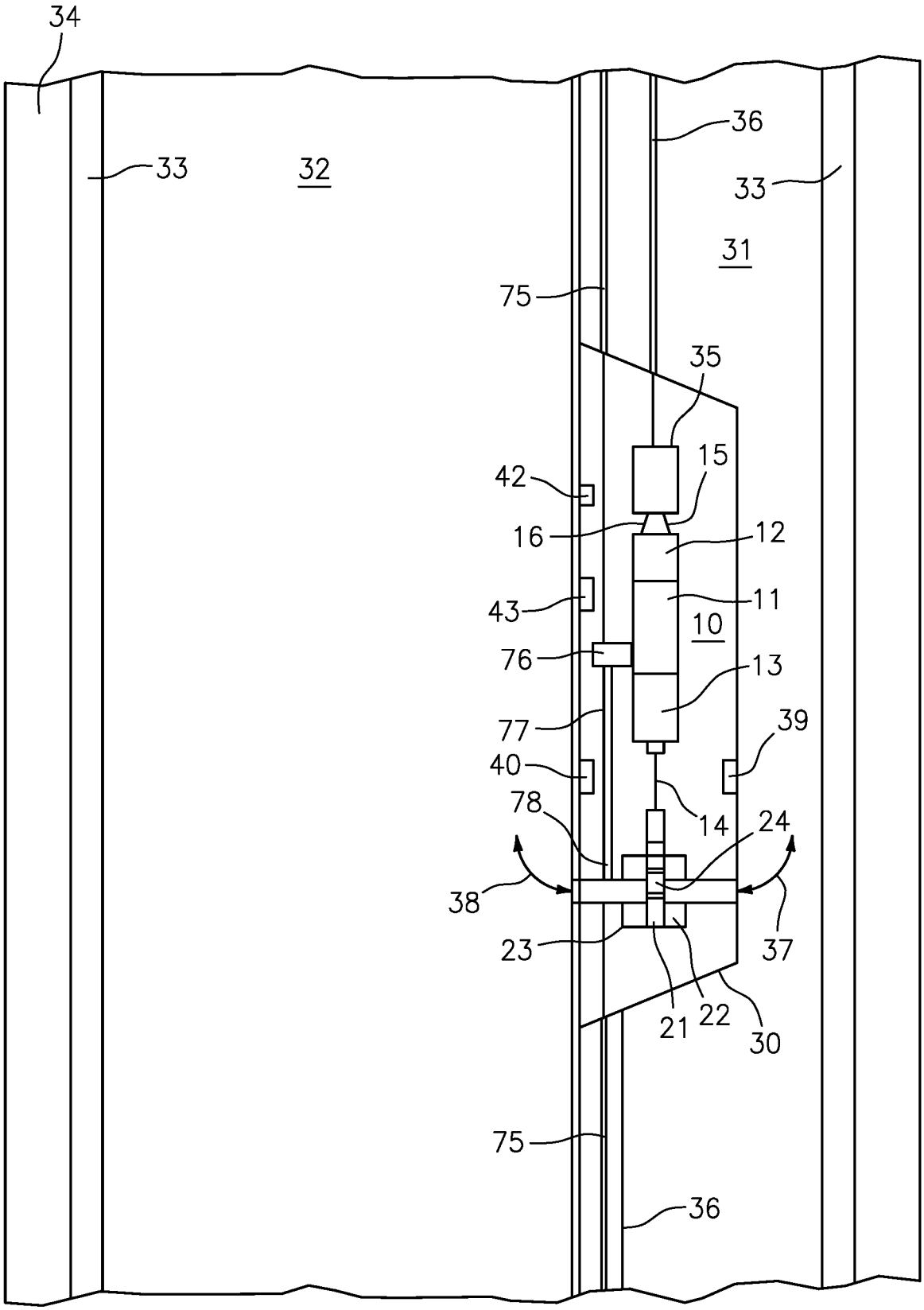
FIG. 8 is an illustration, in partial section, of a control valve installed in an oil well in accordance with the present invention.
Figure 9:
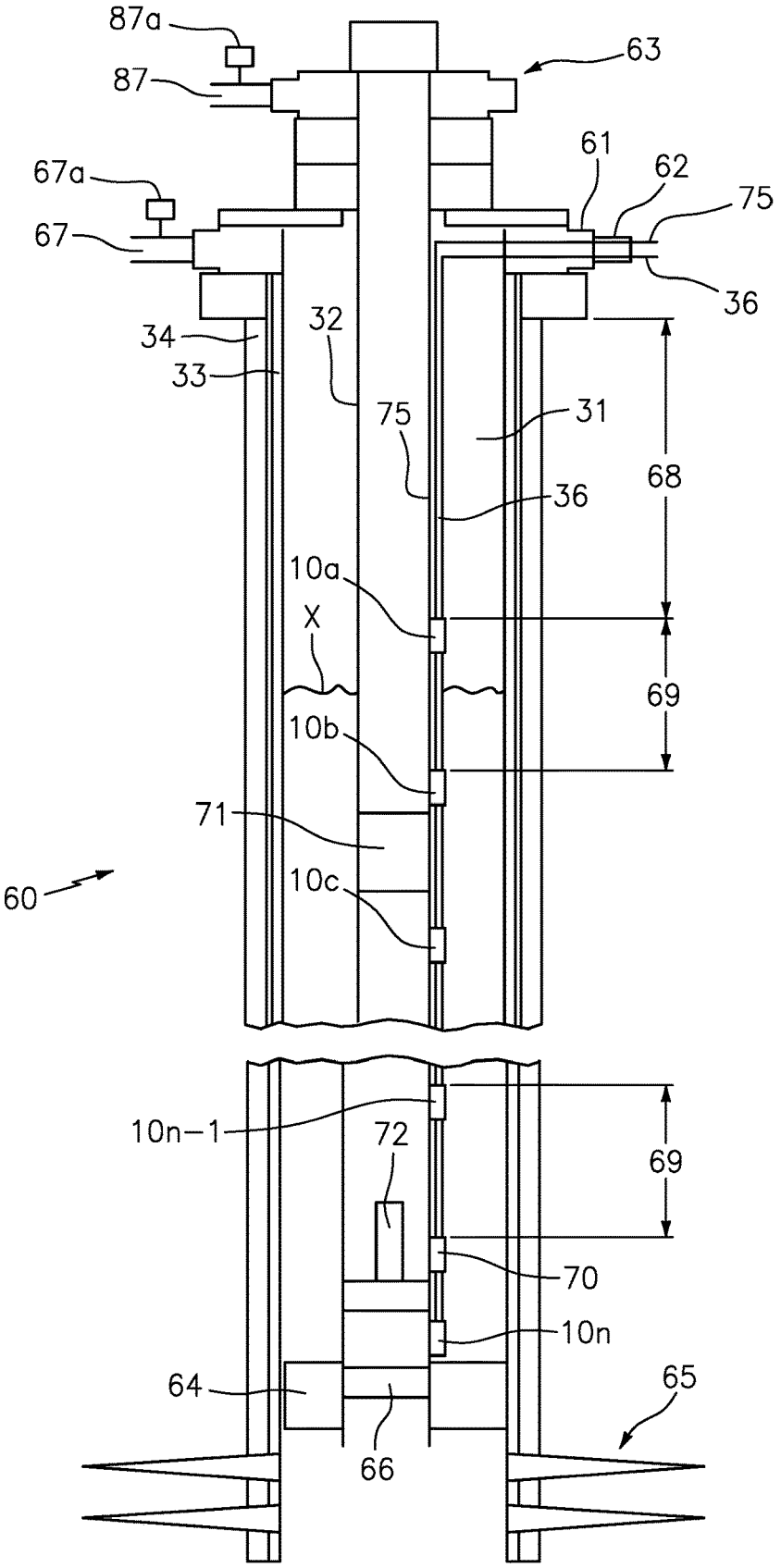
FIG. 9 is an illustration, in partial section, of a control valve system installed in an oil well in accordance with the present invention.

Referring now to FIG. 9, there is shown a control valve and monitoring system 60 installed within a wellbore comprising a plurality of control valves including control valve 10*a*, control valve 10*b*, control valve 10*c*, control valve 10*n*-1 and control valve 10*n*. control valves 10*a*-10*n* are similar to control valve 10 of FIG. 8 and are positioned within annular chamber 31 and mounted to production tubing 32 and provide selective bidirectional fluid communication between the annular chamber 31 and the production tubing 32. The ability of control valve 10 of the present disclosure to provide selective bidirectional fluid communication between the annular chamber 31 and the production tubing 32 is enables the control valve to be cleared of paraffin, scale, and or other debris, which is a big advantage over prior art valves. control valves 10*a*-10*n* are electrically connected to each other via power cable 36 and are further electrically connected to surface equipment and controls (FIG. 10) by communication and power cable 36 that passes through wellhead 61 via wellhead penetrator 62. As disclosed herein above, it should be appreciated by those skilled in the art that annular chamber 31 is formed by production tubing 32 and casing 33 and is bounded on the top by wellhead 61 and production tree 63 and on the bottom end by packer 64. Packer 64 is normally positioned above perforations 65 through which production fluids (not shown) enter the wellbore and flow into the production tubing 32. In this particular embodiment, gas from a lifting fluid supply can be injected into either the annular chamber 31 for annular injection of an annular injection fluid or production tubing 32 for tubing injection of a tubing injection fluid. In an embodiment concerning annular injection, an injection gas enters the system via casing wing valve 67 mounted in wellhead 61 and wherein the annulus pressure within annulus 31 can be determined using annulus pressure sensor 67*a*. The injection gas will travel down annular cavity 31 and displacing well fluid on the first injection or previously injected gas until it reaches a control valve 10*a*-10*n*. When any particular control valve is at least partially open. the injection fluid passes through the control valve and the production and injection fluids travel up the production tubing 32 and out the production wing valve 87 of the production tree 63 wherein the production tubing pressure can be determined using surface production sensor 87*a*. The injection fluid passing into the production tubing will lower the density of the production fluid and thus lower the pressure in the production tubing 32 allowing the fluid in annulus cavity 31 to continue to drop lower. The continuously variable positioning and fine adjustment capability of control valve 10 with its near infinite positions enables a change in the injection rate so that it can adjust for changing production fluid properties, rates, and pressures; injection fluid properties, rates, and pressure to create the optimal conditions to lower the pressure on the production tubing 32 to drop the fluid level in annulus cavity 31 as deep and fast as possible under the conditions. In the case of tubing injection, and in embodiments where optional check valve 203 is omitted, the flow is reversed but approach and results are similar, and because the control valve 10 can be configured to allow fluids to flow in both directions 38 and 37, the installation 60 can switch from tubing injection to annulus injection with the same control valves 10*a*-10*n*. With respect to tubing injection, the injection gas enters thought the production wing valve 87 down the production tubing 32, through the control valve and up the annulus 31 and out the casing wing valve 67. control valve 10*a* is mounted a known predetermined depth 68 from the surface and in certain embodiments the spacing between subsequent control valves 10*b*-10*n* can be substantially equal at a spacing 69. control valve 10*n* is therefore positioned at a known depth equal to predetermined depth 68+(spacing 69*n). In the embodiment shown, some or all of control valves 10*a*-10*n* can comprise pressure and temperature sensors 39, 40 as described herein above. Certain embodiments include bottom hole pressure sensor 70 positioned near packer 64 and electrically coupled to pass through cable 36. Bottom hole sensor 70 is normally configured to measure the bottom hole tubing pressure in the production tubing 32, however in some embodiments bottom hole sensor can measure the bottom hole annulus pressure in annulus 31 or the production tubing or both proximate the bottom depth of the well. Because control valves 10*a*-10*n* are capable of continuously variably and finely adjusting the opening of gate 21 and thereby changing its coefficient of discharge, allows the user to install fewer valves in the completion string. In addition, because control valves 10*a*-10*n* are capable of finely adjusting the opening of gate 21 the control valve and monitoring system 60 can dynamically control the position of any of the control valves to adjust for changing conditions in the well.

Figure 10:
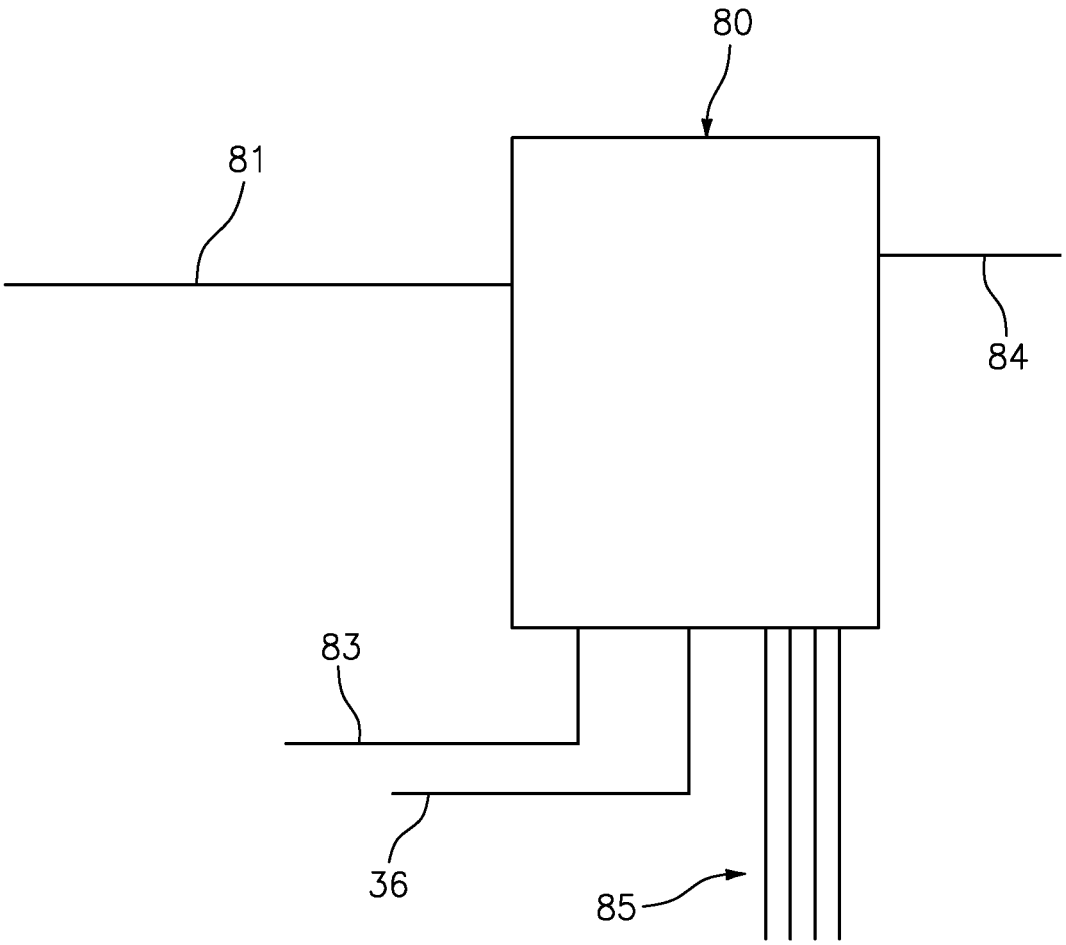
FIG. 10 is a diagram of a control unit in accordance with the present invention.

Referring to FIG. 10, there is shown a surface controller 80, which can comprise a computing device or the like, that provides a connection to a local interface 84, receives and sends data, information, and commands via a network connection 81 to a SCADA or cloud based system, receives power 83 to run the surface controller and the control valve system 60 (FIG. 9), and sends and receives data, information, and commands from local instruments, such as pressure, temperature, flow rate, etc, and control devices such as on/off valves, Emergency Shutdown Down (ESD) valves, flow control valves, etc via local cabling 85.

In addition to the advantages described herein above, control valve 10 and control valve and monitoring system 60 provide other advantages over the prior art including the direct control of the control valves, the sensor data, and continuously variable valve opening position and fine adjustment ability which enables an operator unload a well faster, unload a well with fewer control valves, unload a well in wide variety of well conditions, unload a well using less injection gas, continually optimize the gas injection rate as well or surface operating conditions change, perform shut in integrity tests, inject gas into production tubing 32 at multiple points by controlling control valves 10*a*-10*n*, and operate the well in intermittent gas lift by closing control valve 10*a*-10*n*, then briefly opening the deepest available control valve for a short period of time. All this can be done without changing the configuration of any particular control valve 10. The surface controller 80 (FIG. 10) is also able to instruct control valve and monitoring system 60 to perform the steps to remove the well fluid from the injection side on it is own through a sequence of steps we call "auto unloading". In the auto unloading sequence, the same steps are followed as described above with respect to manual unloading, but surface controller 80 coordinates the steps based on input data from sensors 39, 40, 43, and or 70. In addition, it is also contemplated by the present disclosure that by using a well model, sensor data from sensors 39 and 40, the profile in the gate 21, and the capability of control valve 10 be continuously variably adjusted in fine increments of the gate, the surface controller 80 is able to shift from one control valve injection point to the next deepest with respect to control valves 10*a*-10*n* and FIG. 9. In this sequence the shallowest valve, control valve 10*a*, will be the injection point, when the next deepest valve control valve 10*b* is at least partially opened, a series of steps takes place so that the injection pressure will drop to much or become unstable. The ability of control valves 10*a*-10*n* to be continuously variably and finely adjusted enables the fine tuning of the gas lift process. In accordance with this method, control valve 10*a* is injecting at the optimal rate based on the operating conditions at the surface and the well fluid and injection gas properties. Prior to being at least partially opened control valve 10*b* will cycle from being full open to full close. After the well fluid in production tubing 32 has fallen below control valve 10*b*, as can be verified by sensors 39, 40, or 70; the surface controller 80 will open control valve 10*b* at the same injection rate as it closes control valve 10*a*. Once control valve 10*b* is open to the optimal injection condition for control valve 10*b*, as calculated in the well model in surface controller 80, and using sensors 39, 40, and 70; and control valve 10*a* is fully closed, the new injection point control valve 10*b* will continue to lower the production pressure and cause the well fluids on the injection side to continue to drop to the next control valve, control valve 10*c*. The process is repeated until the system cannot get any deeper because it is limited by either well or operating conditions such as reservoir pressure, injection pressure, injection rate, etc.

It should be appreciated by those skilled in the art that control valve and monitoring system 60 can also include a plunger system. With a standing valve 66 and a plunger stop 72 installed near the bottom of the well. Plunger 71 can comprise a cylindrically shaped length of steel, and in operation is dropped through production tubing 32 to the bottom of the well where it comes to rest on plunger stop 72. control valve 10*n* can be a "fast acting" control valve with a profile 27 (FIG. 6) in gate 21, allowing the rapid injection of gas below the plunger 71. If required, control valves 10*a*-10*n* can be selectively opened and closed to provide gas lift to plunger 71 to move the plunger up production tubing 32 towards the surface. In this manner plunger 71 provides a piston-like interface between liquids and gas in production tubing 32 and increase the ability to lift liquid out of the production tubing 32. In certain embodiments gas needs to be injected into annular chamber 31 through production wing valve 67 to lift plunger 71. However, in other embodiments, plunger 71 can include pads that reduce the gap between the plunger 71 and production tubing 32 and limits liquid fallback and increase lifting forces due to the well's own energy can be used to lift liquids out of the wellbore efficiently. In certain high gas-oil-ratio oil wells and with plunger 71 starting at plunger stop 72, control valves 10*a*-10*n* are selectively controlled to produce a liquid slug by cyclically bringing the plunger to the surface using gas pressure in the casing tubing annulus and from the formation. When control valves 10*a*-10*n* are all positioned in the closed position, plunger 71 falls toward plunger stop 72 and pressure builds again in the well. Use of control valve and monitoring system 60 and plunger 71 allows a shut-in portion of the operational cycle that is only a few seconds long, resulting in more production for many wells, such as high gas-oil-ratio wells. Using sensors 43 (FIG. 8) or temperature and pressure sensor 40 in the production tubing 32, at each control valve 10*a*-10*n*, or a subset thereof, and knowing the spacing 69 between control valves of interest, control valve and monitoring system 60 is capable of sensing the passing of plunger 71, the approximate amount of liquid head the plunger is carrying, and the speed at which the plunger is moving between successive control valves.

Now referring again to FIG. 8, there is shown indicator 42 positioned within housing 30 proximate control valve 10. Indicator 42 is capable of outputting a signal that can be picked up by wireline, memory logging, or other devices like a "Smart plunger". The signal can be a magnet, radioactive source, RFID transmitter, or other types. This signal can be used to provide an exact location of the control valve 10 in the completion string. In addition, there is also shown tool sensor 43 mounted within housing 30 and capable of indicating when a wire line, slick line, plunger, or other device has passed the valve. Tool sensor 43 can be a proximity switch, a magnetic flux indicator, an RFID reader, or a physical mechanical switch that protrudes slightly into the ID of production tubing 32. The detection of a Wireline, Slickline, or plunger device may also be determined by sensor 40. Using sensor 40, indicator 42, or sensor 43 (or other positioning means) and knowing the exact position of control valve 10 at multiple locations along production tubing 32, the position or speed at which tools or devices are moving can be determined.

With reference to FIGS. 8, 9, using temperature and pressure sensor 39 in the annulus 31, at successive control valves 10*a*-10*n* down the well (not necessarily every control valve), and knowing the spacing 69 between the successive control valves, for example between control valve 10*a* and control valve 10*b*, control valve and monitoring system 60 is capable of calculating the density of the fluid being injected, the density of the fluid in the annulus that is being displaced, and the interface point X (or level) where those two fluids meet (also called the liquid level height) The density of the injection fluid and the well bore fluid can be determined in accordance with the following equation:

$$\Delta P = g \times \Delta H \times \rho \qquad \text{(Equation 1)}$$

Where ΔP is the differential pressure between control valve 10*a* and control valve 10*b*, *g* is gravity, ΔH is the distance between the two valves 69 and p is the density of the fluid. The pressure difference is known from sensors 39 and the spacing 69 between the two sensors is known, Equation 1 can be solved for the fluid density. To solve for the fluid height in the annulus which can be located between two successive control valves one can use the fluid densities determined by Equation 1. control valve and monitoring system 60 provides the pressure difference between the two sensors 39, the distance between those two sensors 69, and fluid density from Equation 1 above (for example the injection fluid density) and the density of the fluid below (for example the wellbore fluid density), the control valve and monitoring system can determine the interface point X in accordance with the following equation by solving for X:

$$\Delta P = (g \times X \times \rho_{injection\ fluid}) + (g \times (\Delta H - X) \times \rho_{wellbore\ fluid}) \qquad \text{(Equation 2)}$$

Because control valves 10*a*-10*n* include sensors 39, 40 there exists a distributed pressure and temperature system along the length of the completion giving control valve and monitoring system 60 advantages over the prior art including the capability to detect plunger 71 traveling up and down production tubing 32, determine the speed at which the plunger travels which can relate to efficiency, accurately locate control valves 10*a*-10*n* and to precisely control the control valves, determine a flow profile within production tubing 32, and determine a liquid level on the gas injection side. Because control valve 10 is capable of precisely controlling the position of gate 21 and includes sensors 39, 40 positioned on either side of the control valve, the control valve of the present disclosure has other advantages of the prior art. In embodiments that include sensors 39, 40, control valve and monitoring system 60 has the capability to determine if the liquid has been emptied on the injection side of the control valve, and the ability to calculate a flow rate through the control valve as disclosed herein above, even if multiple control valves are open. Because control valve 10 includes an inside valve seat 23 and an outside valve seat 22 the control valve further enables the operating of the well in both directions (annulus injection and tubing injection) through the valve opening without having to remove the completion and to perform an integrity test in either direction of operation.

Still referring to FIGS. 9 and 10, control valve and monitoring system 60 inventively enables the unloading of the well in what is referred to herein as automatic unloading. In automatic unloading a well model containing well geometry, well operating conditions, and fluid properties are uploaded into the surface box 80 through the local display 84, network communication 81, or surface sensors and instruments 85. From the well model the surface box 80 calculates what each operational opening should be for control valves 10*a*-10*n*. The operational openings can be recalculated if any of the above parameters change. Injection fluid, most commonly compressed natural gas, is pressurized and injected into either the annual space 31 or the production tubing 32 depending on the configuration of the well as described herein above. The injection of fluid will displace the existing well fluid through the sequential opening of control valves 10*a*-10*n*. control valve and monitoring system 60 is capable of determining the fluid levels and status of the operation through sensors 39, 40, 43, and 70. In operation, all control valves 10*a*-10*n* start in the full open position. Just prior to the injection fluid reaching control valve 10*a*, control valve 10*a* will shift to its preprogrammed operating position. The injection fluid will begin gas lifting the production fluid. This will continue to lower the well fluid on the injection side. Just prior to the fluid level on the injection side reaching the next control valve 10*b*, control valve 10*b* will shift from full open to closed. Once the injection fluid has passed control valve 10*b*, control valve 10*a* will begin to close at a constant rate that is matched by control valve 10*b* until control valve 10*a* is fully closed and control valve 10*b* is at its calculated operational opening. This process will continue automatically until the deepest injection point, possibly control valve 10*n*, is reached based on the operating conditions and fluid properties. If any of these operating conditions for fluid properties change surface box 80 of control valve and monitoring system 60 can calculate a new maximum operating depth and can sequence control valves 10*a*-10*n* to achieve that depth as described immediately herein above.

Referring now to FIGS. 8, 9, 10 control valve and monitoring system 60 enables the fine control of the production of a well. control valve and monitoring system 60 obtains pressure readings from the production tubing via production pressure sensor 87*a* and the pressure of the annulus via annulus pressure sensor 67*a* as well as bottom hole pressure and optionally bottom annulus pressure using bottom hole pressure sensor 70 along with sensors 39, 40 positioned at some or all of control valve's 10*a*-10*n* along the depth of the well. In addition, the rate of injection of injection fluids can be provided to control valve and monitoring system 60 via network connection 81, a local interface 84, or local instruments 85. control valve and monitoring system 60 uses the above mentioned sensor information, surface controller 80, using math models for the well, both for the production and injection sides, to determine the which control valve's 10*a*-10*n* to achieve the deepest point of injection. Controller 80 will change the continuously variable control valves in sequence from shallowest 10*a* to deepest (toward 10*n*), to displace any well fluids that are in annulus 31, to expose the control valve that is the deepest in the completion string based on the available injection rate at the surface and well operating conditions. As surface conditions, as indicated by production pressure sensor 87*a* and surface annulus pressure sensor 67*a* change and well conditions as indicated by bottom hole pressure sensor 70 and sensors 39, 40 positioned at some or all of control valve's 10*a*-10*n* change, surface controller 80 is configured to continuously variably adjust any particular control valve 10*a*-10*n*, or shift to a higher or lower control valve based on the new conditions.

FIG. 8 shows an optional chemical injection line that can connect to each of the control valves, or only certain control valves. These control valves have a feed through line and injection valve built into them. Injection valve can be opened from the surface box 80 whenever desired. This will allow the flow of chemical injection fluid from the surface to any specific control valve the user desires. The chemical injection line is fed through the wellhead using a special penetrator and is connected to high-pressure chemical injection pump.

Figure 11:
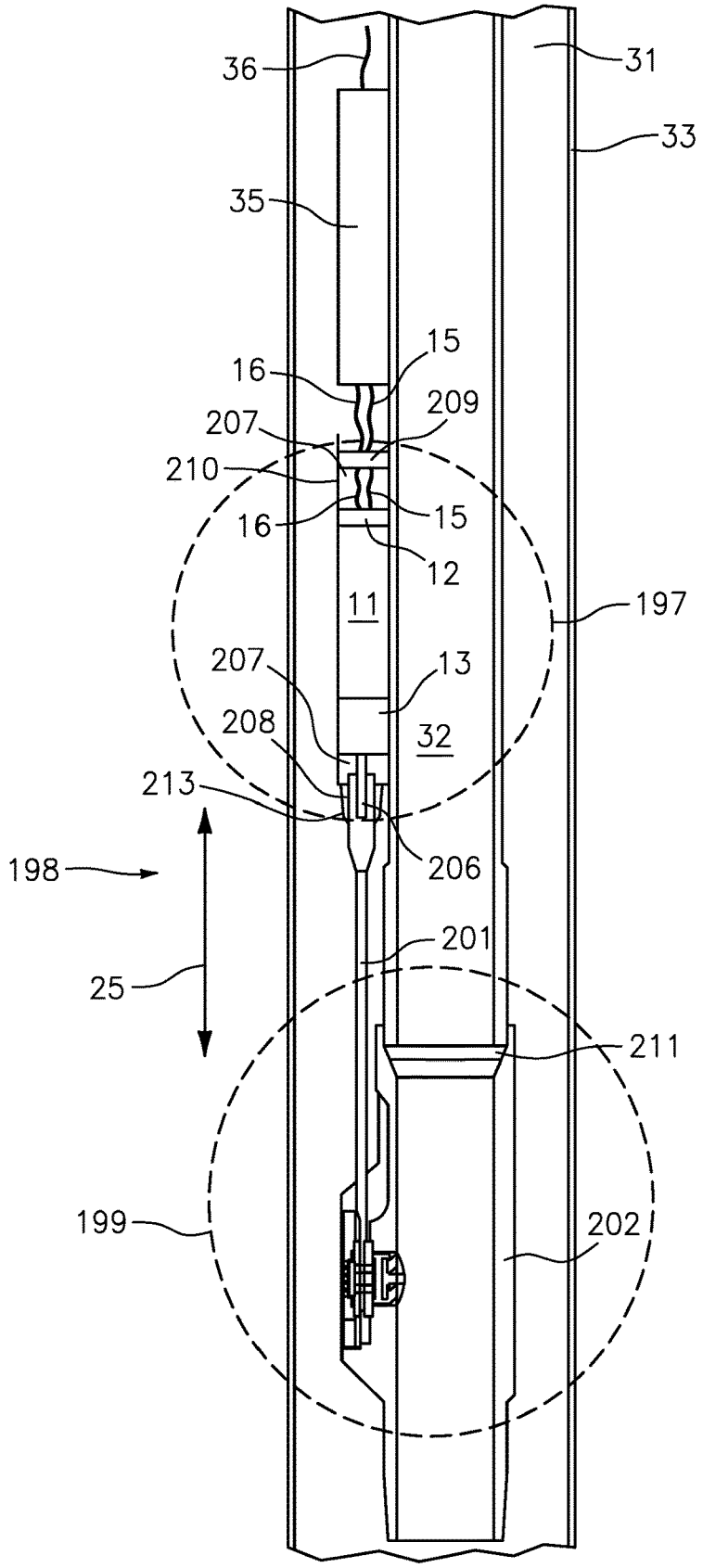
FIG. 11 is an illustration, in partial section, of a control valve system in accordance with the present invention.

Referring now to FIG. 11, there is shown an embodiment of a control valve system 198 of the present disclosure mounted to the outside of production tubing 32 below the surface in a downhole environment. In this particular embodiment, control valve system 198 is comprised of motor section 197 and control valve assembly 198. Motor section 197 includes electric motor 11, position sensor 12, gear reduction assembly 13, power thread 206, bellows 208, housing 210, and oil balance chamber 207 and compensation piston 209 the detail of which will be described in more detail hereinafter. control valve system 198 further includes electronics assembly 35 in electronic communication with position sensor 12 and motor 11, which is connected to the power cable 15 and encoder wires 16. Electronics assembly 35 is connected to communication and power cable 36 that runs from the surface to control valve system 198. Electronics assembly 35 can include such hardware capable of providing communication, power management, sensor calculations, memory and the like. Valve assembly 199 includes a gate 21 fixedly attached to connecting rod 201, the detail of which will be described herein after. Power thread 206 is coupled to gearbox 13 and is threadedly engaged into a proximal end of connecting rod 201. Motor 11 is a rotary motor and can be an inductance motor or a permanent magnet motor and is coupled to gearbox 13 to rotate power thread 206 in a clockwise or counterclockwise direction. When power thread 206 is rotated in or out of internal threads in the proximal end of connecting rod 201 the connecting rod linearly translates and gate 21 is bidirectionally moved in the direction of arrow 25 to provide a plurality of continuously variable positions between a fully closed position and a fully open position and the fine adjustment of the amount of open area of gate profile and a precise valve opening positioning capability thereby.

In operation, control valve system 198 needs to have enough total force on gate 21 to maintain the gate in a predetermined position in such a way that any forces created by flow or pressure through the valve do not cause it to change its predetermined position. Motor 11 can be a permanent magnet which is selected to resist backspin and can include a locking feature such as a motor detent brake or a clutch activated break (not shown) to increase the motor's resistance to being back driven. In addition, gearbox 13 is a high gear ratio gearbox, which can be of about a 600:1 ratio, and the use of a power thread 206, which can be a stub acme thread, reduces the backspin forces on the motor and further maintains the predetermined position of gate 21 from the aforementioned forces.

It should be appreciate by those skilled in the art from the present disclosure that control valve 10 balances the electrical power available via power cable 15 (from the surface, a battery, or an electrical energy storage device), to the force that the actuation mechanism can generate (for opening or closing), to the speed at which it gate 21 will translate in the direction of arrow 25. In certain embodiments of control valve 10, motor 11 can comprises a permanent magnet electric motor which can include a braking mechanism (not shown) to which the motor is coupled to a high output multistage gearbox 13, and the gear box is coupled to a ball screw linear actuator 301 which can comprise a power thread such as a ⅜-12 stub acme. In addition, position sensor 12 can comprise an absolute position encoder (or a hall effect sensor) to determine the number of motor rotations so that the exact position of gate 21 and the valve opening thereby, is known.

Control valve system 198 is fixedly attached to valve sub 202 and the valve sub is connected in hydraulic communication to production tubing 32 by joint 211 positioned in the uphole end which can comprise a screw joint. In operation, valve sub 202 is further connected in hydraulic communication to another section production tubing (not shown) on its downhole end which production tubing is in turn in hydraulic communication with reservoir fluids. In this particular embodiment production fluids flow in the uphole direction through the valve sub 202 and into production tubing 32 and on up to the surface. control valve system 198 and production tubing 32 are mounted within casing 33 and form annulus 31 therebetween. This arrangement is similar to that described with reference to FIGS. 8 and 9 wherein control valve system 198 can comprise any of control valve 10*a*-10*n* and the production fluids enter the production tubing perforations 65 and exit at the surface through production wing valve 87.

Figure 12:
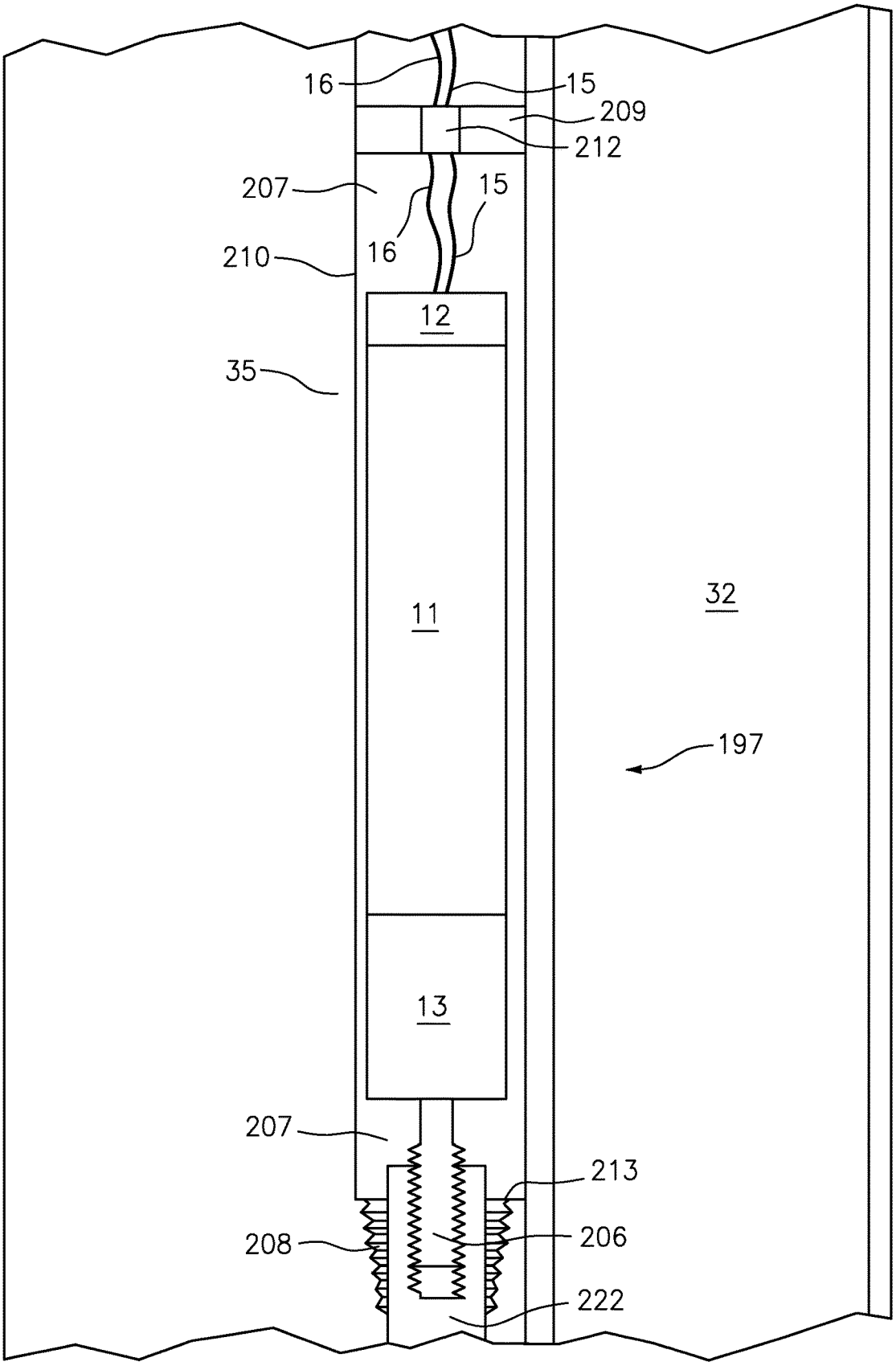
FIG. 12 is a detail illustration, in partial section, of a motor section of the control valve of FIG. 11 in accordance with the present invention.

Referring now to FIG. 12, another aspect of control valve system 198 is that some of motor section 197, including position sensor 12, motor 11, gearbox 13, power screw 206 and coupling sleeve 222 of connecting rod 201 can all be positioned within isolated chamber 207. Isolated chamber 207 is defined by housing 210, compensation piston 209 with electrical feedthrough 212 and seal 213 positioned between bellows 208, the housing and coupling sleeve 222. It should be noted that compensation piston 207 is slidably positioned within housing 210 and includes seals on its outer diameter to isolating fluids within isolated chamber 207 form fluids that can exist outside of the housing. Coupling sleeve 222 includes a set of internal threads that mate with power 206 such that as the power screw is rotated by motor 11 through gearbox 13 the rotational movement is converted to axial movement of connecting rod 201. Isolated chamber 207 is filled with a fluid, which can comprise a mineral oil, prior to installation downhole. It should be appreciated by those skilled in the art that the oil provides attributes to control valve system 198 that contribute to reliability including cooling of motor 11, lubrication of the threaded connection between power screw 206 and connecting rod 201 as well as excluding debris from entering the isolated chamber. In operation, as connecting rod 201 translates linearly in the directions of arrow 25, bellows 208 expands and contracts and the compensation piston moves to maintain a semi-constant pressure within isolated chamber 207 so that motor section 197 is isolated from any forces from the annulus pressure effects if it was contained in an atmospheric chamber, and which excludes annulus fluids or debris from entering the isolated chamber.

Figure 13:
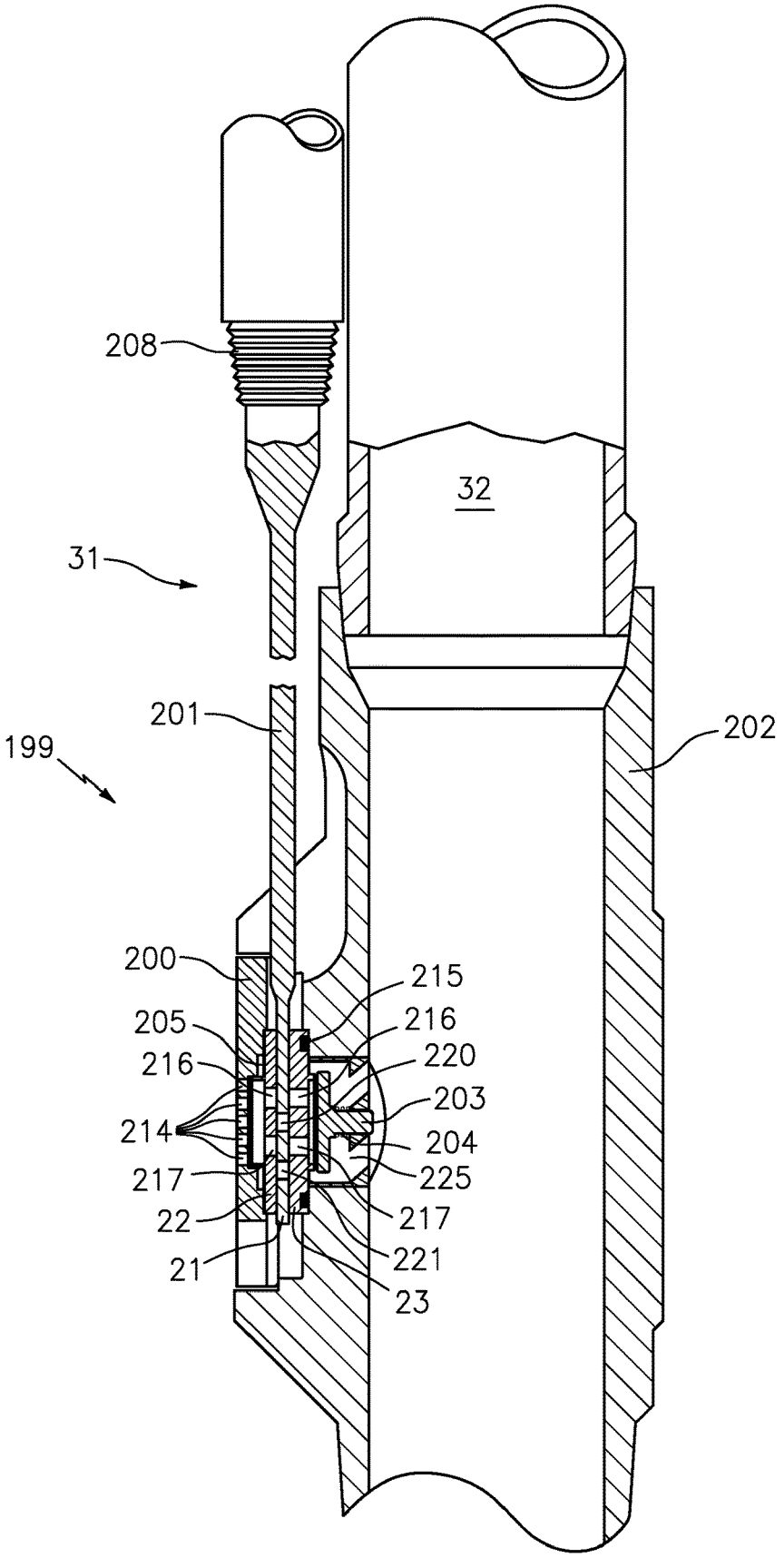
FIG. 13 is a detail illustration, in partial section, of the control valve of FIG. 11 showing the valve in a selected position in accordance with the present invention.
Figure 14:
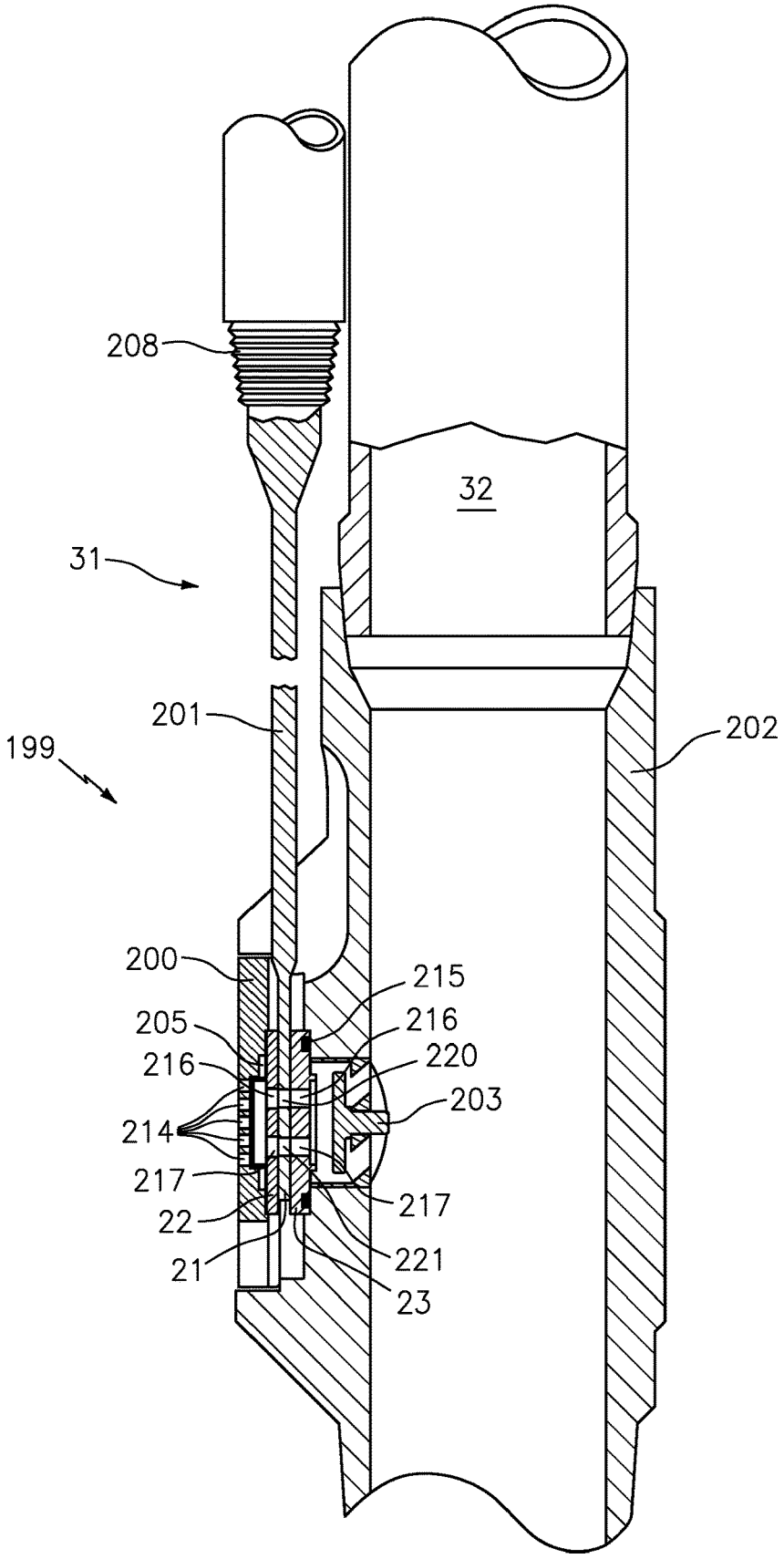
FIG. 14 is a detail illustration, in partial section, of the control valve of FIG. 11 showing the valve in a selected position in accordance with the present invention.
Figure 15:
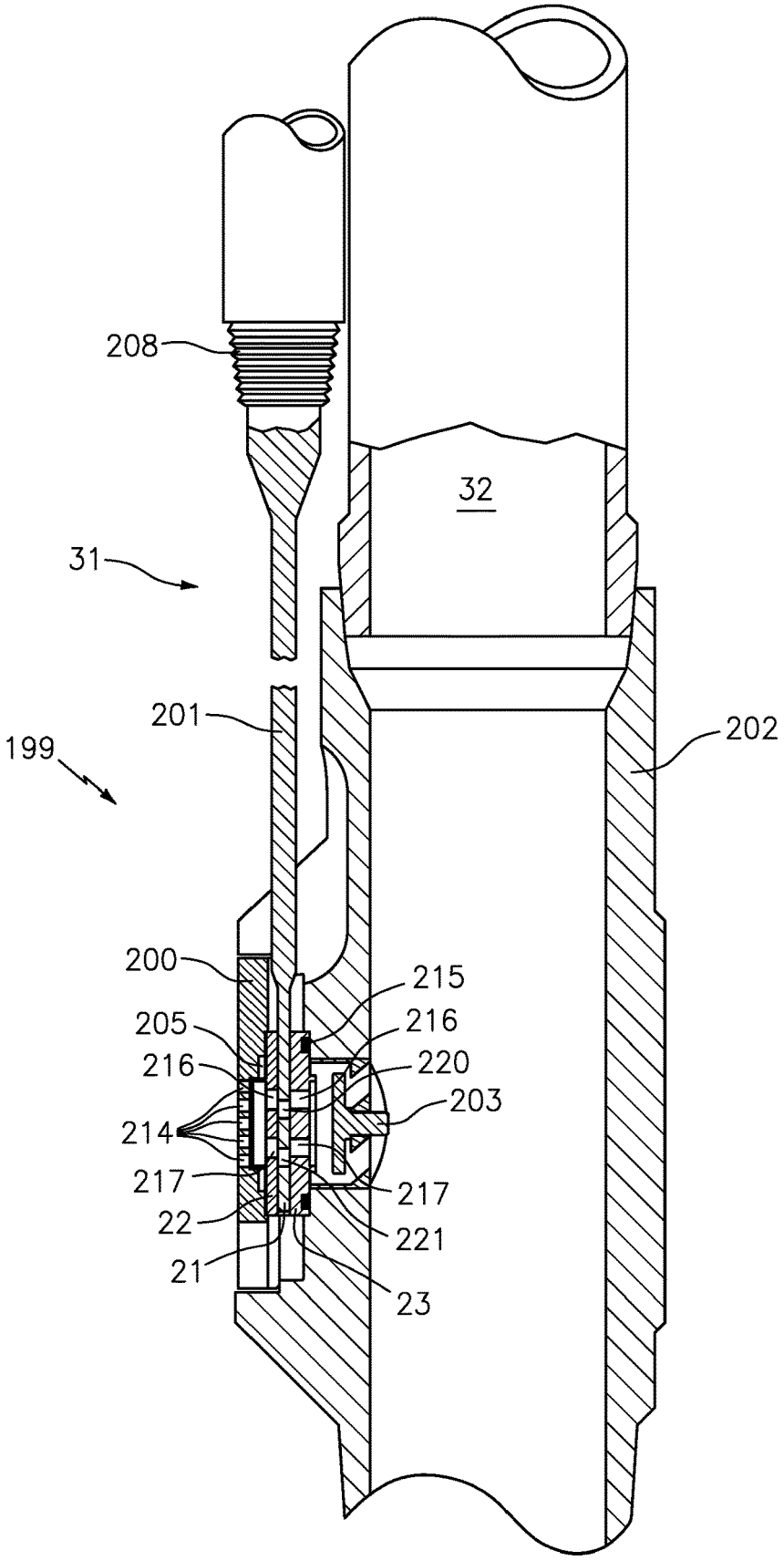
FIG. 15 is a detail illustration, in partial section, of the control valve of FIG. 11 showing the valve in a selected position in accordance with the present invention.

The detail of the embodiment of control valve assembly 199 of control valve system 198 is best shown with reference to FIGS. 13-15. With reference first to FIG. 13, control valve assembly 199 is shown in the fully closed position and includes retaining screen 200 positioned on the outside of valve sub 201, preload spring 205, outside valve seat 22, gate 21, inside valve seat 23 and optional check valve 203. In certain embodiments of control valve system 198 wherein optional check valve 203 is not included, fluids can flow from annulus 31 through sub port 225 into the primary bore of valve sub 202 and into production tubing 32 and conversely fluids can flow from the production tubing into the annulus enabling the control valve system to function as a bidirectional valve as will be described in more detail herein after. In this particular embodiment, retaining screen 200 is fixedly attached to valve sub 201 and includes a plurality of screen ports 214 through which fluids can pass with little resistance. Inside valve seat 23 includes seal 215 positioned between the inside valve seat and a portion of valve sub 201 and further includes outlet ports 216, 217. Outside valve seat 22 is positioned between gate 21 and retaining screen 200 and includes inlet ports 218, 219. Further, gate 21 is fixedly attached to connecting rod 201 and includes gate ports 220, 221. Outlet ports 216, 217, inlet ports 218, 219 and gate ports 220, 221 can having matching sizes and profiles or differing sizes and profiles. In the embodiment shown, two sets of matching ports are disclosed which have matching profiles that most closely resemble the set of three matching ports of gate profile 27 (FIG. 6), that is the profiles are elongated oval shaped. The fixing of retaining screen 200 biases preload spring 205 against inside valve seat 22, gate 21 and inside valve seat 23 to seal production tubing 32 from annulus 31 with control valve assembly 199 in the fully closed position as shown and further prevents leakage of fluids between these elements. In the embodiment shown in FIG. 13, connecting rod 201 is translated in the full downhole stroke position rendering outlet ports 216, 217, inlet ports 218, 219 and gate ports 220, 221 in a fully closed position with no hydraulic communication between production tubing 32 and annuls 31. In certain embodiments, the fully closed position is located at the end of stroke of connecting rod 201 wherein the full stroke between the fully closed position (FIG. 13) and fully open (FIG. 14) is approximately 0.25 inches. In other embodiments the fully closed positioned can be located at the beginning of the stroke of connecting rod 201 and in still other embodiments the fully closed position can be achieved at multiple points along the linear translation of the connecting rod. In other embodiments of control valve 10 of the present disclosure, the full stroke length can be 6 inches or longer.

Now referring to FIG. 14, there is shown control valve valve assembly 199 with gate 21 positioned in the fully opened position. In this embodiment, power screw 206 has been rotated in the clockwise direction by motor 11 through gearbox 13 a sufficient amount to fully align outlet ports 216, 217, inlet ports 218, 219 and gate ports 220, 221 to allow unimpeded fluid flow therethrough in accordance with the $C_D$ of the ports. In this fully opened position injection fluid can be introduced into annulus 31 and it will enter the control valve assembly through screen ports 214, flow through outlet ports 216, 217, gate ports 220, 221 and inlet ports 218, 219. If the pressure of the injection fluid is greater than the fluid pressure in production tubing 31 the injection gas pressure will overcome the force of spring 204 and lift check valve 203 off of its seat allowing the injection fluid to enter valve sub 202 and the production tubing to provide gas lift operations in the manner described herein before. The injection fluid will remain flowing from annulus 31 to production tubing 32 for as long as injection fluid pressure is higher than the pressure within production tubing 32 or when the control valve assembly 198 is ordered closed using surface controller 80 (FIG. 10). In embodiments of control valve assembly 199 wherein optional check valve 203 has been omitted, the introduction of injection fluid from annulus 31 to valve sub 202 and production tubing 32 occurs for as long as injection fluid pressure is higher than the pressure within production tubing 32 or when gate 21 of control valve assembly 199 is ordered closed using surface controller 80 (FIG. 10). In situations wherein a method of tubing injection, injecting a fluid into wing valve 87 and into production tubing 31, is desired this particular embodiment of control valve assembly 199 inventively enables the injection gas to travel from the production tubing and valve sub 202 through inlet ports 218, 219, gate ports 220, 221 and outlet ports 216, 217 to allow unimpeded fluid flow therethrough and into annulus 32 where it can travel to the surface and exit through wing valve 67.

Now referring to FIG. 15, there is shown control valve valve assembly 199 with gate 21 positioned in a partially opened position. In this embodiment, power screw 206 has been rotated in the clockwise direction by motor 11 through gearbox 13 a sufficient amount to partially align outlet ports 216, 217, inlet ports 218, 219 and gate ports 220, 221 to allow restricted fluid flow therethrough in accordance with the $C_D$ of the partially opened ports. In this partially opened position, injection fluid can be introduced into annulus 31 and it will enter the control valve assembly through screen ports 214, flow through outlet ports 216, 217, gate ports 220, 221 and inlet ports 218, 219. If the pressure of the injection fluid is greater than the fluid pressure in production tubing 31 the injection gas pressure will overcome the force of spring 204 and lift check valve 203 off of its seat allowing the injection fluid to enter valve sub 202 and the production tubing to provide gas lift operations in the manner described herein before. The injection fluid will remain flowing from annulus 31 to production tubing 32 for as long as injection fluid pressure is higher than the pressure within production tubing 32 or when the control valve assembly 198 is ordered closed, or other partially opened position, using surface controller 80 (FIG. 10). In embodiments of control valve assembly 199 wherein optional check valve 203 has been omitted, the introduction of injection fluid from annulus 31 to valve sub 202 and production tubing 32 occurs for as long as injection fluid pressure is higher than the pressure within production tubing 32 or when gate 21 of control valve assembly 199 is ordered closed using surface controller 80 (FIG. 10). In situations wherein a method of tubing injection, injecting a fluid into wing valve 87 and into production tubing 31, is desired, this particular embodiment of control valve assembly 199 inventively enables the injection gas to travel from the production tubing and valve sub 202 through partially aligned inlet ports 218, 219, gate ports 220, 221 and outlet ports 216, 217 to allow a partially restricted fluid flow therethrough and into annulus 32 where it can travel to the surface and exit through wing valve 67.

Figure 16:
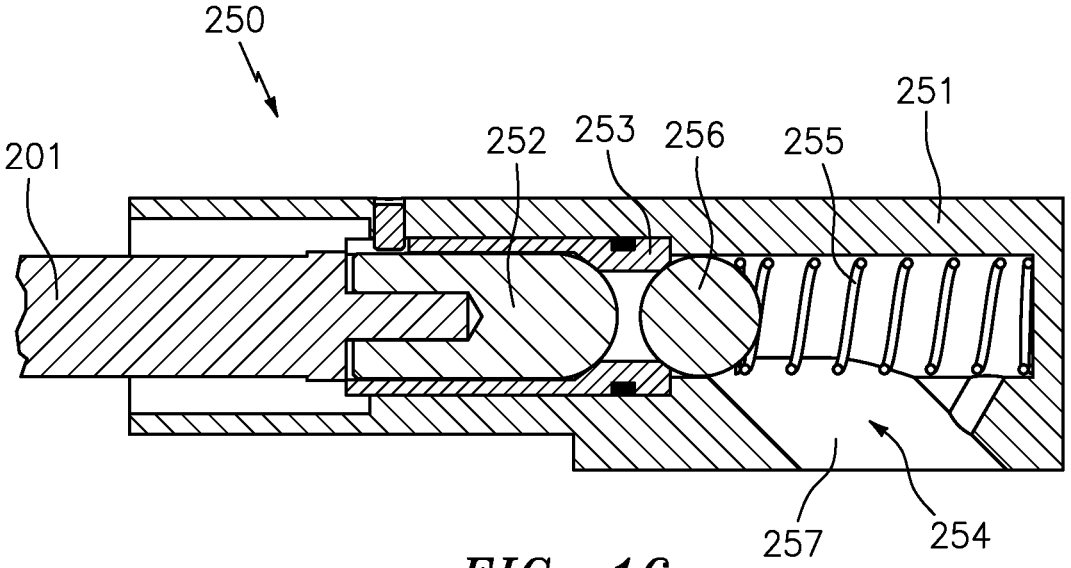
FIG. 16 is a detail illustration, in partial section, of an alternative embodiment of a valve assembly in a selected position in accordance with the present invention.
Figure 17:
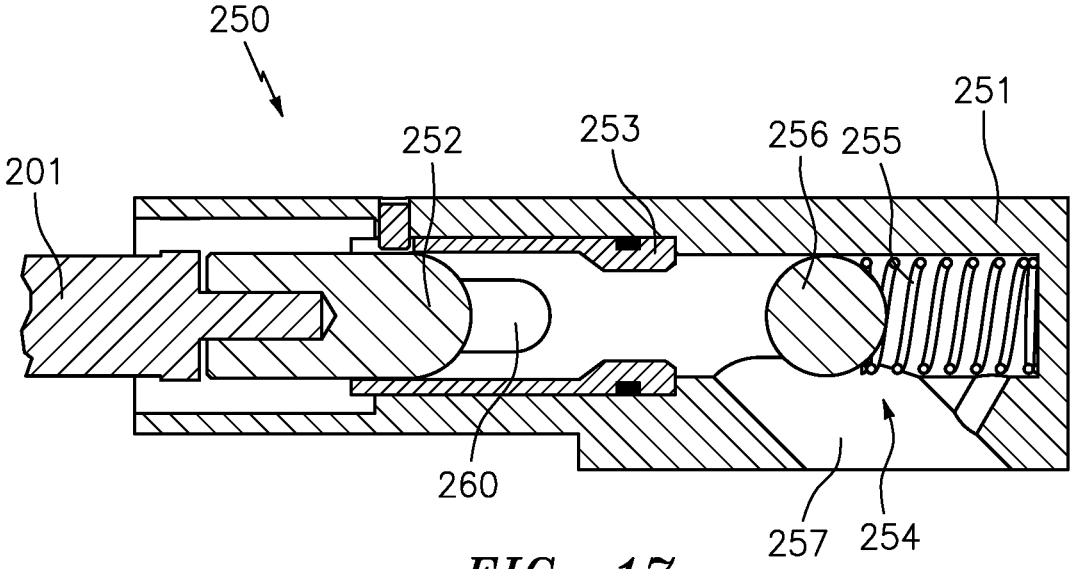
FIG. 17 is a detail illustration, in partial section, of an alternative embodiment of a valve assembly in a selected position in accordance with the present invention.

An alternative control valve assembly 250 is shown in FIGS. 16-17 wherein valve housing 251 is fixedly attached to valve sub 202 (FIG. 11). With reference first to FIG. 16, control valve assembly 250 includes connecting rod 201 fixedly attached to a gate in the form of valve pin 252 which is slidably positioned within valve housing 251 and is further sealing inlet 260 and positioned against valve seat 253 in a closed position providing a double sealing mechanism. In this embodiment, power screw 206 has been rotated in the counterclockwise direction by motor 11 through gearbox 13 a sufficient amount to fully valve pin 252 against valve seat 253. control valve assembly 250 further includes optional check valve assembly 254 comprised of check spring 255 and check ball 256 which is shown biased against valve seat 253 by the check spring in a closed position. control valve assembly 251 further includes outlet port 257 that is adapted to be in hydraulic communication with valve sub 202 and production tubing 32. In this closed position, there exists no fluid flow from the annulus 31 to the valve sub 202 and similarly no fluid flow from the valve sub to the annulus. Now with reference to FIG. 17, there is shown control valve assembly 250 with valve pin 252 positioned in a partially opened position. In this embodiment, power screw 206 has been rotated in the clockwise direction by motor 11 through gearbox 13 a sufficient amount to lift valve pin 252 off valve seat 253 and partially exposing inlet port 260 to allow restricted fluid flow therethrough in accordance with the $C_D$ of the partially opened port. In this partially opened position, injection fluid can be introduced into annulus 31 and it will enter the control valve assembly 250 through inlet port 260. If the pressure of the injection fluid is greater than the fluid pressure in production tubing 32, the injection gas pressure will overcome the force of check spring 255 and lift check ball 256 off of valve seat 253 allowing the injection fluid to enter valve sub 202 through outlet port 257 and the production tubing to provide gas lift operations in the manner described herein before. The injection fluid will remain flowing from annulus 31 to production tubing 32 for as long as injection fluid pressure is higher than the pressure within production tubing 32 or when the control valve assembly 198 is ordered closed, or other partially opened position, using surface controller 80 (FIG. 10). In embodiments of control valve assembly 250 wherein optional check valve 254 has been omitted, the introduction of injection fluid from annulus 31 to valve sub 202 and production tubing 32 occurs for as long as injection fluid pressure is higher than the pressure within production tubing 32 or when valve pin 252 of control valve assembly 250 is ordered closed using surface controller 80 (FIG. 10). In situations wherein a method of tubing injection, injecting a fluid into wing valve 87 and into production tubing 32, is desired, this particular embodiment of control valve assembly 250 omits optional check valve assembly 254 and inventively enables the injection gas to travel from the production tubing and valve sub 202 through at least partially open inlet port 260 to allow at least a partially restricted fluid flow therethrough and into annulus 32 where it can travel to the surface and exit through wing valve 67.

As should be appreciated by those skilled in the art, the control valve, the control valve and monitoring system and methods for their use provide numerous benefits. The disclosed embodiments allow for bi-directional flow through the control valve from the annulus to the production tubing or from the production tubing to the annulus. Embodiments of the control valve disclosed provide powerful, positionably stable, fast, finely and continuously variably positioning of the control valve that is remotely controllable. Along with disclosed sensors and a control processor the control valve and monitoring system allows for optimal production of a well and continuous, individual, and ongoing management and control of a plurality of control valve's. A power cable can be coupled to each control valve, which allows for control and measurements for the plurality of control valve's without requiring a hydraulic control line.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated other The terms "comprise" (and any form of comprise, such as "comprises," and "comprising"), "have" (and any form of have, such as "has," and "having"), "include" (and any form of include, such as "includes" and "including") and "contain" (and any form of contain, such as "contains" and "containing") are open-ended linking verbs. As a result, a system, device, or apparatus that "comprises," "has", "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

While the foregoing is directed to embodiments of the present invention, other and further embodiments of the invention may be devised without departing from the basic scope thereof, and the scope thereof is determined by the claims that follow.

What is claimed is:

1. A downhole valve for controlling fluid flow, comprising:

a drive section comprising:

a motor adapted to provide rotational movement of a motor shaft;

a position sensor coupled to the motor and adapted to determine a rotation position of the motor;

a gearbox coupled to the motor shaft and adapted to provide a rotational movement of a gearbox shaft; and a linear actuator coupled to the gearbox and adapted to convert the rotational movement of the gearbox shaft to an axial movement in an axial direction;

a connecting rod coupled to the linear actuator; and a valve assembly comprising:

an inlet and an outlet;

a gate slidably positioned between the inlet and the outlet, the gate coupled to the linear actuator;

a motor controller coupled to the motor and adapted to control the axial movement such that the connecting rod causes the gate to translate in the axial direction between the inlet and the outlet;

wherein the motor controller is further adapted to control the axial movement in a continuously variable mode such that the connecting rod causes the gate to translate in the axial direction to a plurality of continuously variable positions between a fully closed position and a fully open position; and a valve seat and wherein the gate comprises a valve pin and wherein the valve pin is positioned against the valve seat in the fully closed position.

2. The downhole valve for controlling fluid flow of claim 1 further comprising a check valve positioned proximate the outlet and adapted to prevent fluid flow from the outlet to the inlet.

3. The downhole valve for controlling fluid flow of claim 1 wherein the linear actuator is threadably engaged with a portion of the connecting rod.

4. The downhole valve for controlling fluid flow of claim 1 further comprising:

a valve sub having a substantially cylindrical primary bore and a sub port and adapted to be in fluid communication with a production tubing of an oil well;

wherein the outlet is positioned substantially perpendicular to the substantially cylindrical primary bore and in fluid communication with the sub port; and wherein the downhole valve is adapted to control fluid flow between the sub port and the inlet.

5. The downhole valve for controlling fluid flow of claim 4 wherein the downhole valve is adapted to control fluid flow in a bidirectional mode in any of a first direction from the inlet to the sub port and a second direction from the sub port to the inlet.

6. The downhole valve for controlling fluid flow of claim 4 further comprising a check valve positioned proximate the sub port and adapted to prevent fluid flow from the substantially cylindrical primary bore to the inlet.

7. The downhole valve for controlling fluid flow of claim 1 further comprising:

one or more components forming a housing;

a compensation piston sealable positioned in an inside of the housing;

a bellows coupled to the housing;

wherein the bellows is further coupled to the connecting rod; and wherein the axial movement causes an expansion of the bellows or a compression of the bellows and further causes the compensation piston to move axially.

8. The downhole valve for controlling fluid flow of claim 7 further comprising an isolated chamber defined by the inside of the housing, the compensation piston and the bellows and wherein the isolated chamber is substantially filled with an incompressible fluid.

9. The downhole valve for controlling fluid flow of claim 8 wherein any of the motor, the gearbox, the position sensor and the linear actuator are positioned within the isolated chamber.

10. A method of operating a downhole control valve comprising:

providing a valve assembly having a plurality of continuously variable positions between a fully open position and a fully closed position;

providing a control signal to the valve assembly;

controlling a fluid flow through the valve assembly;

wherein the providing of the control signal comprises:

rotating a motor;

rotating a gearbox coupled to the motor;

actuating a linear actuator coupled to the gearbox;

producing an axial movement of a gate coupled to the linear actuator; and positioning the gate to a predetermined one of the plurality of continuously variable positions; and wherein the positioning the gate to a predetermined one of the plurality of continuously variable positions comprises sensing a rotational position of the motor and positioning the gate based on the rotational position.

11. The method of operating a downhole control valve of claim 10 further comprising:

coupling the valve assembly to a production tubing string in a well; and controlling a fluid flow between the production tubing string and an annulus.

12. The method of operating a downhole control valve of claim 11 further comprising:

sensing at least one parameter; and adjusting the gate to a different predetermined one of the plurality of continuously variable positions based on the at least one parameter.

13. The method of operating a downhole control valve of claim 12 further comprising determining a flow rate through the valve assembly based on the at least one parameter.

14. The method of operating a downhole control valve of claim 11 wherein the controlling a fluid flow between the production tubing string and an annulus is any of controlling the fluid flow from the production tubing string to the annulus and controlling the fluid flow from the annulus to the production tubing string.

* * * * *